US010399350B2

(12) United States Patent
Kon et al.

(10) Patent No.: US 10,399,350 B2
(45) Date of Patent: Sep. 3, 2019

(54) INK CARTRIDGE, METHOD FOR TAG DISCRIMINATION IN SAME, METHOD FOR REPRODUCING INK CARTRIDGE

(71) Applicant: RISO KAGAKU CORPORATION, Tokyo (JP)

(72) Inventors: Shotaro Kon, Ibaraki (JP); Kenichi Ozeki, Ibaraki (JP); Toshio Hamada, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/417,643

(22) Filed: Jan. 27, 2017

(65) Prior Publication Data

US 2017/0217196 A1 Aug. 3, 2017

(30) Foreign Application Priority Data

Jan. 29, 2016 (JP) ..... 2016-016074
Feb. 29, 2016 (JP) ..... 2016-037510
Feb. 29, 2016 (JP) ..... 2016-037511

(51) Int. Cl.
*B41J 2/175* (2006.01)

(52) U.S. Cl.
CPC ..... *B41J 2/17553* (2013.01); *B41J 2/1755* (2013.01); *B41J 2/17546* (2013.01); *B41J 2/17559* (2013.01)

(58) Field of Classification Search
CPC combination set(s) only.
See application file for complete search history.

(56) References Cited

U.S. PATENT DOCUMENTS 4,961,088 A * 10/1990 Gilliland ..... G03G 15/553 399/12
5,506,611 A * 4/1996 Ujita ..... B41J 2/17503 347/19
6,416,152 B1 * 7/2002 Matsuzaki ..... B41J 2/17503 347/19

(Continued)

FOREIGN PATENT DOCUMENTS

EP 2 894 035 7/2015
JP 2010-082994 4/2010

OTHER PUBLICATIONS

Extended European Search Report for EP 17153576.8 dated Aug. 10, 2017.

*Primary Examiner* — Anh T Vo
(74) *Attorney, Agent, or Firm* — Greenblum & Bernstein, P.L.C.

(57) ABSTRACT

An engagement part fitted in an outer package of an ink cartridge is provided with: a fit-in rib which is provided at a circumferential edge on a rear side and which serves as a guide upon engagement with an opening of the outer package; an engagement rib provided upright at the circumferential edge of the engagement hole in the same direction as a direction of the fit-in rib; and a bonding region for bonding a communication tag that performs near field radio communication with a printer. A tag-removing hole which is formed in the bonding region and which is to be removed from a bonding surface side of the communication tag with a bar-like member inserted is formed in a formation region as the bonding region located in a first quadrant and a fourth quadrant in an orthogonal coordinate system.

20 Claims, 14 Drawing Sheets

(56) References Cited

U.S. PATENT DOCUMENTS 6,588,871 B2 * 7/2003 Studholme ..... B41J 2/17503 347/19
7,168,797 B2 1/2007 Arai et al.
7,407,266 B2 * 8/2008 Kimura ..... B41J 2/17513 347/19
7,672,610 B2 * 3/2010 Causey ..... G03G 21/181 399/109
8,197,042 B2 * 6/2012 Akiyama ..... B41J 2/17509 347/85
8,215,754 B2 * 7/2012 Akiyama ..... B41J 2/17513 347/19
2002/0035940 A1 * 3/2002 Sasaki ..... B41F 31/02 101/480
2003/0063147 A1 * 4/2003 Walker ..... B41J 2/17509 347/19
2003/0123887 A1 * 7/2003 Imes ..... G03G 21/1889 399/24
2004/0135857 A1 * 7/2004 Hashii ..... B41J 2/17503 347/86
2004/0165046 A1 * 8/2004 Arai ..... B41J 2/1752 347/86
2005/0196180 A1 * 9/2005 Harumoto ..... G03G 15/0863 399/12
2006/0053030 A1 * 3/2006 Nakamura ..... B41J 2/17546 705/308
2007/0263044 A1 * 11/2007 Nip ..... B41J 2/1753 347/84
2007/0297828 A1 * 12/2007 Causey ..... G03G 21/181 399/109
2008/0253799 A1 * 10/2008 Causey ..... G03G 21/1892 399/109
2008/0256230 A1 * 10/2008 Handley ..... H04L 63/145 709/224
2009/0002431 A1 * 1/2009 Osawa ..... B41J 2/175 347/20
2009/0243857 A1 10/2009 Sunagawa et al.
2010/0073442 A1 * 3/2010 Akiyama ..... B41J 2/17509 347/86
2010/0085404 A1 * 4/2010 Akiyama ..... B41J 2/17513 347/86
2011/0002713 A1 * 1/2011 Taguchi ..... G03G 15/0863 399/262
2011/0020039 A1 * 1/2011 Mitsuishi ..... G03G 15/0832 399/262
2011/0044703 A1 * 2/2011 Fuse ..... G03G 21/1892 399/12
2011/0217067 A1 * 9/2011 Tokuno ..... G03G 15/0863 399/110
2013/0321538 A1 * 12/2013 Ishizawa ..... B41J 2/17506 347/86
2014/0286670 A1 * 9/2014 Takahashi ..... G03G 21/1652 399/83
2015/0293474 A1 * 10/2015 Mitsuishi ..... G03G 15/0832 399/260
2017/0217196 A1 * 8/2017 Kon ..... B41J 2/1755

* cited by examiner

| | REMOVAL DEGREE | PINCHING DEGREE |
|---|---|---|
| COMPARATIVE EXAMPLE 1 | ○ | × |
| EXAMPLE 1 | ○ | △ |
| EXAMPLE 2 | ○ | △ |
| EXAMPLE 3 | △ | ○ |
| EXAMPLE 4 | ○ | ○ |

| | REMOVAL DEGREE | PINCHING DEGREE |
|---|---|---|
| COMPARATIVE EXAMPLE 1 | ○ | × |
| EXAMPLE A | ○ | △ |
| EXAMPLE B | ○ | ○ |

| | REMOVAL DEGREE | PINCHING DEGREE |
|---|---|---|
| COMPARATIVE EXAMPLE 1 | ○ | × |
| EXAMPLE C | ○ | △ |
| EXAMPLE D | ○ | ○ |

INK CARTRIDGE, METHOD FOR TAG DISCRIMINATION IN SAME, METHOD FOR REPRODUCING INK CARTRIDGE

TECHNICAL FIELD

The present invention relates to an ink cartridge attached to and detached from an inkjet printer that discharges ink to a printed medium to print an image, a method for discriminating a communication tag bonded to the cartridge, and a method for reproducing an ink cartridge.

BACKGROUND OF ART

Conventionally used for an inkjet printer that prints a desired image on paper serving as a printed medium has been an ink cartridge for the inkjet printer (hereinafter simply referred to as an "ink cartridge") that stores an ink container having an ink derivation section and an ink storage section for ink supply to an ink head.

There have been demands on such an ink cartridge for achieving easier performance of attachment to and detachment from the inkjet printer, having tolerance to, for example, fall during transport and handling processes and vibration upon transport, and achieving fabrication at low costs. Thus, to meet the demands described above, the applicants of the present invention have provided an ink cartridge as disclosed in Patent Literature 1 below.

CITATION LIST

Patent Literature

{Patent Literature 1} Japanese Patent Application Laid-open No. 2010-82994

Conventional ink cartridges face the following problems. A concave part for facilitating removal of a bonded communication tag is formed in a bonding region on an engagement surface of the ink cartridge disclosed in Patent Literature 1. However, there arises a problem that the formation of the concave part is difficult and costly. Moreover, when viewed from an abutting surface side, a sink is formed at a convex part between the formed concaved parts and waving occurs on the entire surface, bringing about a problem of poor appearance.

A conventional method for tag discrimination faces the following problem. In the conventional ink cartridge, upon operation of discrimination between the engagement surface and the communication tag, a bar-like member is inserted from a tag-removing hole to remove part of the communication tag and pinch and further remove the aforementioned removed and floated portion. However, at a position of the tag-removing hole formed on the engagement surface, the floated portion is formed at a corner part of the engagement surface, so that a fit-in rib provided upright at a circumferential edge of the engagement surface becomes an obstacle and interferes with the insertion of an operator's finger, resulting in difficulties in pinching the floated portion.

A conventional ink cartridge reproduction faces the following problems. A conventional ink cartridge is provided with a communication tag including a memory (a storage unit) that stores various pieces of information (hereinafter collectively referred to as "cartridge information") related to ink and an ink cartridge with which a printer as a loading destination makes communication through near field radio communication.

The printer reads out the cartridge information stored in the communication tag of the loaded ink cartridge, recognizes in what state the loaded ink cartridge is provided, and performs control in accordance with the current state of the ink cartridge.

Therefore, in a case where ink head control performed upon ink discharge differs from one ink to another, a difference between a type of ink in the ink cartridge and a type of ink recorded in the communication tag raises a problem that the ink head is clogged. Moreover, since a user transmits a print job while monitoring a remaining amount of ink, a difference between an amount of ink remaining in the ink container and an amount of ink recorded in the communication tag results in a state in which the remaining amount of ink becomes zero during the print job, raising a problem that print processing is cancelled.

Further, the cartridge information stores, in addition to the ink-related information such as ink remaining amount information and empty information, a wide range of information such as information of compatibility with the printer and information related to user services. Thus, unless accurate information is stored, there arises a problem that the user cannot be provided with stable functions and performance.

As described above, the information stored in the communication tag is very important information for smoothly and stably performing print processing, and thus needs to be in correspondence with a fabricated ink cartridge.

However, upon reproduction of an ink cartridge, the specifications and a state of the corresponding ink cartridge vary, and thus the cartridge information needs to be rewritten accordingly, operation of which requires much labor. Moreover, since the cartridge information stores, in addition to the ink-related information such as the ink remaining amount information and the empty information, the wide range of information such as the information of compatibility with the printer and the information related to user services, operation of confirming whether or not all the aforementioned pieces of information are properly rewritten is required, which is very complicated operation.

Further, the communication tag is an electronic device that is vulnerable to moisture such as ink, and thus needs to be once detached from the cartridge in order to avoid breakage and contamination of the communication tag as a result of dispersion of the ink injected in the ink container. However, when the communication tag has been rewritten, the detached communication tag needs to be attached to the corresponding ink cartridge again, which requires complicated operation of communication tag management.

Solution to Problem

Thus, in view of the problems described above, the invention has been made, and it is an object of the invention to provide an ink cartridge that permits easy operation of communication tag discriminating upon disposal of the ink cartridge while suppressing manufacturing costs of the ink cartridge, a method for discriminating a communication tag bonded to the ink cartridge, and a method for reproducing an ink cartridge that permits reproduction steps to be accurately carry out by using a communication tag storing cartridge information corresponding to the ink cartridge.

A first aspect of the invention refers to an ink cartridge having a communication tag on which cartridge information including ink information related to ink filled in an ink container is written, in which the communication tag is bonded in a manner such as to be partially superposed on a tag-removing hole formed at a position located out of a corner part of an engagement part engaging with a printer provided with a function of reading the cartridge information and supplying the ink in the ink container.

A second aspect of the present invention refers to the ink cartridge according to the first aspect, in which the engagement part to which the communication tag is bonded in a manner such as to be partially superposed on the tag-removing hole is fitted in an opening part of a new outer package in which the ink container is stored.

A third aspect of the invention refers to the ink cartridge according to either of the first and second aspects, in which the tag-removing hole is further formed at a position located out of a center of gravity of the communication tag bonded to the engagement part.

A fourth aspect of the invention refers to the ink cartridge according to any of the first to third aspects, in which the engagement part has: a fit-in rib formed at a circumferential edge of a body; an engagement hole formed at a substantially central portion of the body and engaging with a supply opening communicating together an inside and an outside of the ink container stored in an outer package having an opening of a rectangular shape; an engagement rib provided upright at a circumferential edge of the engagement hole in the same direction as a direction of the fit-in rib; and a bonding region for bonding the communication tag formed of a chord part and a circular arc part and formed in a state in which the chord part is in contact with a base end of the fit-in rib on a short side at a position horizontally adjacent to the engagement hole, and the tag-removing hole is formed in a formation region Ea as a region within the bonding region located in a first quadrant and a fourth quadrant obtained upon partitioning with an orthogonal coordinate system having, as coordinate axes, a virtual line X and a virtual line Y, the virtual line X passing through, as an origin, a center O of a virtual circle VC formed by linking together ends part of the circular arc part of the bonding region and positively directing a direction parallel to a long side of the engagement part and approaching the engagement rib, the virtual line Y passing through the center O in a direction orthogonal to the virtual line X.

A fifth aspect of the invention refers to the ink cartridge according to the fourth aspect, in which the tag-removing hole is formed in formation regions Eb including: a region located in the formation region Ea in the first quadrant and between a virtual line L1 drawn from the center O of the virtual circle VC to the circumferential edge of the engagement hole through circumference on a first quadrant side and the virtual line Y; and a region located in the formation region Ea in the fourth quadrant and between a virtual line L2 drawn from the center O of the circle VC to the circumferential edge of the engagement hole through circumference on a fourth quadrant side and the virtual line Y.

A sixth aspect of the invention refers to the ink cartridge according to the fifth aspect, in which when a virtual circle VC1 concentric to the virtual circle VC is formed with a radius ra that is half of a radius r of the virtual circle VC, the tag-removing hole is formed in formation regions Ec which are included in the formation regions Eb located in the first quadrant and the fourth quadrant and which include a region in which a hole center is arranged on circumference of the virtual circle VC1 and a region located on an outer side than the virtual circle VC1.

A seventh aspect of the invention refers to the ink cartridge according to the sixth aspect, in which a virtual line L3 is drawn from the center O towards the circumference on the first quadrant side in the virtual circle VC in a manner such as to equally divide the first quadrant side of the formation region Ec, a virtual line 4 is drawn from the center O towards the circumference on the fourth quadrant side in the virtual circle VC in a manner such as to equally divide the fourth quadrant side of the formation region Ec, and the tag-removing hole is formed in formation regions Ed including a region partitioned by the virtual line L3 and the virtual line L1 in the formation region Ec located on the first quadrant side, a region partitioned by the virtual line L4 and the virtual line L2 in the formation region Ec located on the fourth quadrant side, and a region in which the hole center is arranged on the virtual line L3 and the virtual line L4.

An eighth aspect of the invention refers to the ink cartridge according to any of the first to third aspects, in which the engagement part has: a fit-in rib formed at a circumferential edge of the body on a rear side; an engagement hole formed at a substantially central portion pf the body and engaging with a supply opening communicating together an inside and an outside of the ink container stored in an outer package having an opening of a rectangular shape; and an engagement rib provided upright at a circumferential edge of the engagement hole in the same direction as a direction of the fit-in rib, and in which the tag-removing hole is at least partially formed in a formation region Ee as a region located on an engagement rib side at a position covered by the communication tag bonded between the fit-in rib and the engagement rib and also partitioned by a virtual perpendicular line PL passing through a center of gravity G of the communication tag to form a right angle with the fit-in rib on a long side.

A ninth aspect of the invention refers to the ink cartridge according to the eighth aspect, in which the tag-removing hole is formed in a formation region Ef as a region included in the formation region Ee and partitioned by virtual lines L5 and L6 linking together a center O1 of the engagement hole and corner parts at which the fit-in rib on a short side and the fit-in rib on a long side intersect with each other and which are located on a side on which the communication tag is bonded.

A tenth aspect of the invention refers to a method for tag discrimination including the steps of: inserting a bar-like member in the tag-removing hole formed in the ink cartridge according to the first aspect and then removing and floating part of the communication tag bonded to the engagement part; and pinching the floated portion and removing the communication tag from the engagement part for discrimination of the communication tag.

An eleventh aspect of the invention refers to a method for reproducing an ink cartridge having a communication tag in which cartridge information including ink information related to ink is written; and the method includes, for bonding a replacement communication tag, a step of removing the communication tag provided in a manner such as to be superposed on a tag-removing hole formed at a position located out of a corner part of an engagement part engaging with a printer provided with a function of reading the cartridge information and supplying ink in an ink container.

A twelfth aspect of the invention refers to a method for reproducing an ink cartridge reproduction, the ink cartridge including a communication tag in which cartridge information including ink information related to ink is written, the method including a step of arranging a replacement communication tag in a manner such as to be partially superposed on a tag-removing hole formed at a position located out of a corner part of an engagement part engaging with a printer provided with a function of reading the cartridge information and supplying ink in an ink container.

A thirteenth aspect of the invention refers to the method for reproducing an ink cartridge according to the eleventh or twelfth aspect, in which the engagement part has: a fit-in rib formed at a circumferential edge of a body; an engagement hole formed at a substantially central portion of the body and engaging with a supply opening communicating together an inside and an outside of the ink container stored in an outer package having an opening of a rectangular shape; an engagement rib provided upright at a circumferential edge of the engagement hole in the same direction as a direction of the fit-in rib; and a bonding region for bonding the communication tag formed of a chord part and a circular arc part and formed in a state in which the chord part is in contact with a base end of the fit-in rib on a short side at a position horizontally adjacent to the engagement hole, and in which the tag-removing hole is formed in a formation region Ea as a region within the bonding region located in a first quadrant and a fourth quadrant obtained upon partitioning with an orthogonal coordinate system having, as coordinate axes, a virtual line X and a virtual line Y, the virtual line X passing through, as an origin, a center O of a virtual circle VC formed by linking together ends part of the circular arc part of the bonding region and positively directing a direction parallel to a long side of the engagement part and approaching the engagement rib, the virtual line Y passing through the center O in a direction orthogonal to the virtual line X.

A fourteenth aspect of the invention refers to the method for reproducing an ink cartridge according to either of the eleventh and twelfth aspects, in which the engagement part has: a fit-in rib formed at a circumferential edge of the body on a rear side; an engagement hole formed at a substantially central portion pf the body and engaging with a supply opening communicating together an inside and an outside of the ink container stored in an outer package having an opening of a rectangular shape; and an engagement rib provided upright at a circumferential edge of the engagement hole in the same direction as a direction of the fit-in rib, and in which the tag-removing hole is at least partially formed in a formation region Ee as a region located on an engagement rib side at a position covered by the communication tag bonded between the fit-in rib and the engagement rib and also partitioned by a virtual perpendicular line PL passing through a center of gravity G of the communication tag to form a right angle with the fit-in rib on a long side.

A fifteenth aspect of the invention refers to the method for reproducing an ink cartridge according to the eleventh aspect, further including a step of arranging the replacement communication tag in a manner such as to partially superpose part of the replacement communication tag on a tag-removing hole formed at a position located out of the corner part of the engagement part.

A sixteenth aspect of the invention refers to the method for reproducing an ink cartridge according to any of the eleventh, twelfth and fifteenth aspects, in which the tag-removing hole is formed at a position located out of a corner part of the fit-in rib provided at a circumferential edge of the engagement part engaged with an outer package in which the ink container is stored, a bar-like member is inserted in the tag-removing hole to float part of the communication tag bonded to the engagement part, and the partial portion is pinched and pulled to remove the communication tag from the engagement part.

A seventeenth aspect of the invention refers to the method for reproducing an ink cartridge according to any of eleventh to sixteenth aspects, in which an adjusting member for adjusting an arrangement position of the replacement communication tag is provided between the replacement communication tag and the engagement part.

An eighteenth aspect of the invention refers to the method for reproducing an ink cartridge according to any of eleventh to seventeenth aspects, further including a step of loading, on a replacement outer package, the ink container provided with the replacement communication tag.

A ninth aspect of the invention refers to the method for reproducing an ink cartridge according to any of the eleventh to eighteenth aspects, further including a step of injecting a predetermined amount of ink in the ink container.

Advantageous Effects of Invention

With the ink cartridge according to the first aspect, the communication tag on which the cartridge information including the ink information related to the ink filled in the ink container is written is bonded in a manner such as to be partially superposed on the tag-removing hole formed at the position located out of the corner part of the engagement part, so that, upon the removal of the communication tag in reproduction, a portion located out of the corner part of the engagement part where the operator's finger is easily inserted is floated, and can easily be pinched and removed. Therefore, upon the reproduction of the ink cartridge, the used communication tag can easily be eliminated and no complicated processing of rewriting the cartridge information stored in the used communication tag is required, which permits accurate reproduction of the ink cartridge.

With the ink cartridge according to the second aspect, as a result of fitting, in a new outer package, the engagement part where the communication tag on which the cartridge information including the ink information related to the ink filled in the ink container is written is bonded in a manner such as to be partially superposed on the tag removing hole, in steps of ink cartridge reproduction, a reproduced product can be provided with the same level of quality as that of a new product without recycling the used outer package which is, for example, contaminated with ink, rubbed, or bent upon usage thereof.

With the ink cartridge according to the third aspect, the tag-removing hole is formed at the position located out of the corner part of the engagement part and further located out of the center of gravity of the communication tag, so that upon the removal of the communication tag, the bar-like member or the like can be inserted in the tag-removing hole to float part of the communication tag at a region distant from the corner part of the engagement part. Therefore, the operator can easily insert his or her finger in the removed and floated portion of the communication tag and can easily pinch the floated portion.

With the ink cartridge according to the fourth aspect, the tag-removing hole is formed in the formation region Ea, so that upon the removal of the communication tag with the bar-like member or the like inserted from the tag-removing hole, the portion located out of the corner part of the engagement part where the operator's finger can easily be inserted floats, and the communication tag bonded to the engagement part can easily be pinched and removed.

With the ink cartridge according to the fifth aspect, as a result of forming the tag-removing hole in the formation region Eb, upon the removal of the communication tag with the bar-like member or the like inserted from the tag-removing hole, the floated portion of the communication tag is located further out of the corner part of the engagement part where the operator's finger can easily be inserted than in the formation region Ea, so that the communication tag can easily be pinched and removed to eliminate the communication tag.

With the ink cartridge according to the sixth aspect, the formation region Ec has a communication tag removal position located more distantly from the corner part of the engagement part than the formation regions Ea and Eb, so that upon insertion of the bar-like member or the like in the formation region Ec, part of the removed and floated communication tag can easily be pinched.

With the ink cartridge according to the seventh aspect, the formation region Ed has a communication tag removing position located more distantly from the fit-in rib than the formation region Ec, so that compared to the tag-removing hole formed in the formation region Ec, the operator's finger hardly makes contact with the fit-in rib and the engagement rib and the portion floated as a result of removing the communication tag can even more easily be pinched.

With the ink cartridge according to the eighth aspect, the tag removing hole is formed in the formation region Ee, so that upon removal and floating of part of the communication tag formed into a desired shape, the communication tag can be floated at a portion distant from the corner part and the fit-in rib of the engagement part. Thus, the operator can easily insert his or her finger in the portion floated by removal with the bar-like member or the like and can easily pinch the floated portion.

With the ink cartridge according to the ninth aspect, with the tag-removing hole formed in the formation region Ef, the communication tag removing position is located more distantly from the fit-in rib and the engagement rib than that with the tag-removing hole formed in the formation region Ee, and is located at a position provided with a gap between the ribs, so that the communication tag can more easily be removed, and the removed and floated portion can even more easily be pinched.

With the ink cartridge according to the tenth aspect, simply by inserting the bar-like member from a front surface side of the engagement part in the tag-removing hole formed in the formation region Ea according to the first aspect, part of the communication tag bonded to the bonding region of the engagement part can be removed and floated at a position where the communication tag can easily be pinched. Thus, the operator can easily remove the communication tag from the engagement section by pinching the floated portion. Therefore, operation of discrimination between the engagement section and the communication tag can be performed smoothly upon disposal of the ink cartridge.

With a method of reproducing an ink cartridge according to the eleventh aspect, the communication tag is arranged in a manner such as to be superposed on the tag-removing hole formed at the position located out of the corner part of the engagement part, so that upon removal of the used communication tag at time of the reproduction of the ink cartridge, the portion located out of the corner part of the engagement part floats, and can easily be pinched and removed.

With the method for reproducing an ink cartridge according to the twelfth aspect, the replacement communication tag is arranged in a manner such that at least part of the replacement communication tag is superposed on the tag-removing hole formed at the position located out of the corner part of the engagement part, whereby the replacement communication tag turning into a used communication tag upon the reproduction of the ink cartridge is floated at the portion located out of the corner part of the engagement part, and can easily be pinched and removed.

With the method for reproducing an ink cartridge according to the thirteenth aspect, the tag-removing hole is formed in the formation region Ea, so that upon the removal of the communication tag with the bar-like member or the like inserted from the tag-removing hole, the portion located out of the corner part of the engagement part where the operator's finger can easily be inserted floats and the communication tag bonded to the engagement part can easily be pinched and removed.

With the method for reproducing an ink cartridge according to the fourteenth aspect, the tag-removing hole is formed in the formation region Ee, so that upon removal and floating of part of the communication tag formed into a desired shape, the portion located distantly from the corner part and the fit-in rib of the engagement part can be floated. Thus, the operator can easily insert his or her finger in the portion floated by the removal with the bar-like member or the like.

With the method for reproducing an ink cartridge according to the fifteenth aspect, the communication tag and the replacement communication tag are each arranged in a manner such as to be superposed on the tag-removing hole formed a position located out of the corner part of the engagement part, so that upon removal of the used communication tag at time of the reproduction of the ink cartridge, a portion located out of the corner part of the engagement part floats and can easily be pinched and removed. Moreover, also upon removal of the replacement communication tag at the time of reproduction of the ink cartridge, a portion located out of the corner part of the engagement part floats and can easily be pinched and removed.

With the method for reproducing an ink cartridge according to the sixteenth aspect, the bar-like member is inserted in the tag-removing hole formed at the position located out of a corner part of the fit-in rib provided at the circumferential edge of the engagement part engaging with the outer package in which the ink container is stored, and on portion of the communication tag provided at the engagement part is floated, pinched, and pulled to thereby remove the communication tag from the engagement part, so that the used communication tag can easily be removed upon the reproduction of the ink cartridge.

With the method for reproducing an ink cartridge according to the seventeenth aspect, the adjusting member is provided between the replacement communication tag and the engagement part, so that upon the reproduction of the ink cartridge, the communication distance between the replacement communication tag and the radio communication section and a communication angle thereof can slightly be adjusted in a manner such as to stabilize a state of communication between the replacement tag and the printer serving as a cartridge loading destination, thus increasing types of the usable communication tag and also providing versatility.

With the method for reproducing an ink cartridge according to the eighteenth aspect, without recycling the used outer package that is, for example, contaminated, rubbed, or bent, an ink container provided with a replacement communication tag can newly be loaded on the outer package newly assembled as a replacement, which can provide a reproduced product with the same level of quality as that of a new product.

With the method for reproducing an ink cartridge according to the nineteenth aspect, an appropriate amount of ink can be injected in accordance with the ink cartridge reproduced to provide an ink cartridge desired by the use.

DESCRIPTION OF EMBODIMENTS

Figure 1A:
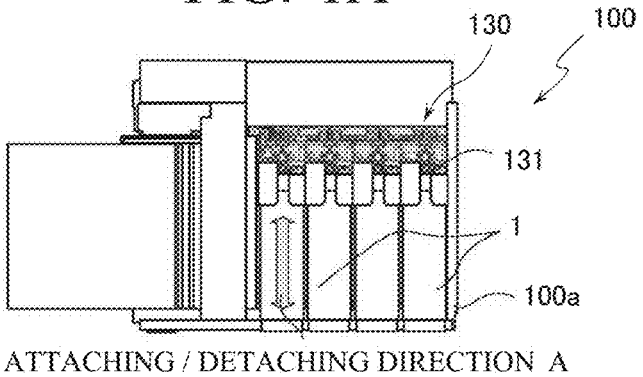
FIG. 1A is a schematic plan view illustrating configuration of an inkjet printer on which an ink cartridge according to the present invention is loaded.

Embodiments of the present invention will be described in detail with reference to the accompanying drawings. The present invention is not limited by the present embodiments, and any other possible embodiments, examples, technologies, etc. that can be carried out by those skilled in the art based on the present embodiments are all included in a scope of the present invention.

In the present specification, when terms top, bottom, right, and left are used to illustrate directions and positions in the following description provided with reference to the accompanying drawings, the aforementioned terms correspond to top, bottom, right, and left when a user views the drawings as illustrated.

A direction in which an ink cartridge 1 according to the present invention is horizontally attached to and detached from a printer 100 is defined as "attaching/detaching direction A", a direction in which the ink cartridge 1 is inserted in and loaded onto the printer 100 is defined as "loading direction A1", and a direction in which the ink cartridge 1 is removed and detached from the printer 100 is defined as "removing direction A2".

Further, the loading direction A1 is equal to a direction in which ink filled in the ink cartridge 1 outflows to the printer 100 (hereinafter referred to as "ink outflow direction B"), and a direction in which an ink container 10 is inserted when stored into an outer package 20 is equal to the removing direction A2.

[1. Overall Configuration of Printer]

As illustrated in any of FIGS. 1A to 1C, the printer 100 loaded with the ink cartridge 1 according to the present invention will be described referring to, as an example, a line color printer of an inkjet type which includes a plurality of ink heads each having a large number of nozzles formed therein and which discharges ink of different colors from the respective ink heads to perform printing on an individual line basis and then forms a plurality of images in a manner such as to superpose the images on each other on printing paper on a conveyance belt.

In the present embodiment, four line-type ink heads are provided. The ink heads respectively discharge the inks of four colors including black (K), cyan (C), magenta (M), and yellow (y) to perform image formation. No limitations are placed on a number of ink heads and colors and types of ink.

The printer 100 includes a control section 110 for performing overall control of various parts composing the aforementioned printer to execute printing processing in accordance with a print job. The control section 110 performs printing processing performed with the ink heads described above, driving control of a conveyance mechanism, and also control related to ink supply from the ink cartridge 1.

Further, connected to the control section 110 is a setting operation section 120 including an input device composed of, for example, operation keys and a display-input panel, and through the setting operation section 120, user's instructions and setting operation can be received.

Figure 1B:
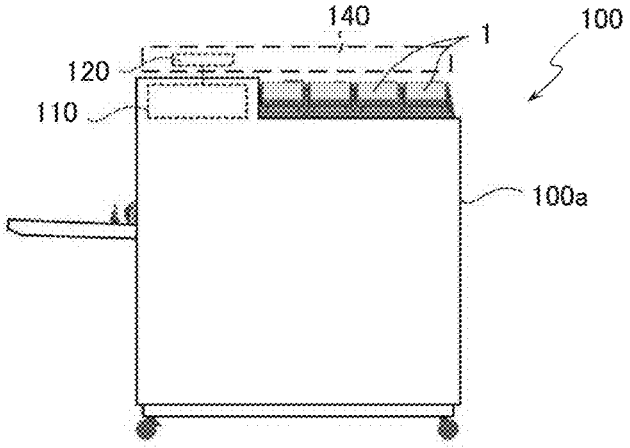
FIG. 1B is a schematic elevation view of the same printer.
Figure 1C:
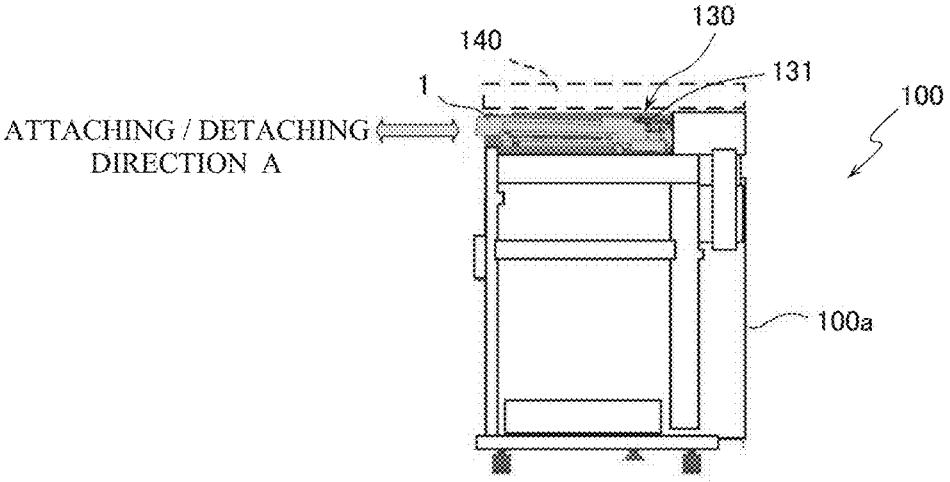
FIG. 1C is a schematic side view of the same printer.

As illustrated in FIGS. 1A and 1C, at a top part of a device body 100*a* in the printer 100, a plurality of (four in accordance with the number of ink heads in the figure) cartridge attaching mechanisms 130 to which the ink cartridge 1 is attached are provided for the respective ink heads.

A top device 140 is arranged in a manner such as to cover a top of the cartridge attaching mechanisms 130. Upon the loading of the ink cartridges 1, the ink cartridges 1 are inserted horizontally between a bottom surface of the top device 140 and a top surface of a main body of the printer 100. Arranged at the top device 140 are: for example, an image reader (scanner) that optically reads a document set in an auto document feeder (ADF) upon conveyance of the document to convert the document into digital data; and the setting operation section 120 described above.

Further, the cartridge attaching mechanism 130 is provided with a holder part 131 that is fitted in an engagement part 30, to be described later on, upon the loading of the ink cartridges 1 on the printer 100.

The holder part 131 includes a holder side joint part, not illustrated, that is fitted in a supply section side joint part 18 provided at an ink supply section 13, to be described later on, assembled to the engagement part 30 in a manner such as to cover the ink supply section 13. Upon the loading of the ink cartridge 1 on the printer 100, the engagement part 30 and the holder side joint part are fitted in each other whereby an inner plug 15, to be described later on, is pushed in against a biasing force of a biasing unit 16 to communicate an inside and an outside of the ink supply section 13 with each other. As a result, an ink outflow path formed between the ink container 10 and an ink path, not illustrated, provided in the printer 100 is opened, thus making it possible for the ink in the ink container 10 to outflow along the ink outflow direction B.

Figure 2:
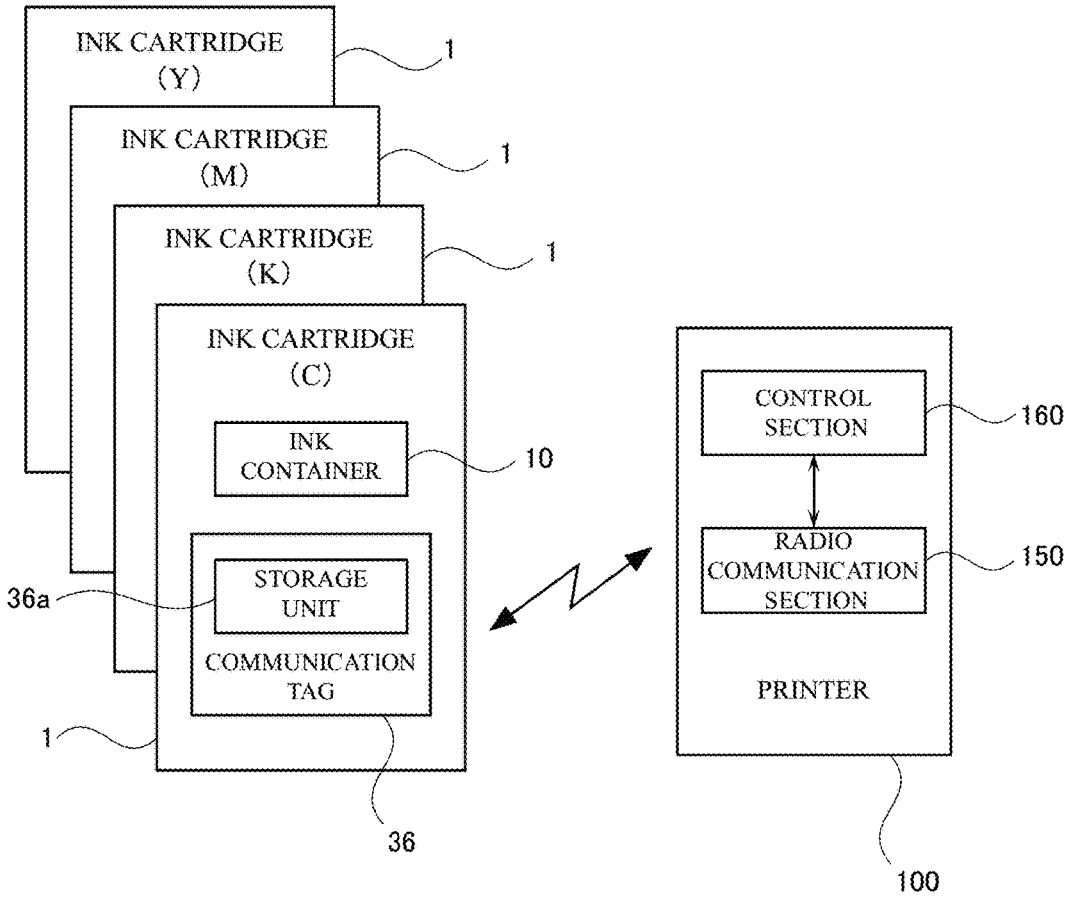
FIG. 2 is a schematic block diagram illustrating functions of the printer and the ink cartridge according to the invention.

As illustrated in FIG. 2, the printer 100 includes: a radio communication section 150 that has a function of reading and writing cartridge information (details of which will be described later on) indicating specifications and a state of the ink cartridge 1 from and into a communication tag 36 provided in the ink cartridge 1 and the ink cartridge 1; and a control section 110 that performs overall driving control of various sections forming the printer 100.

The radio communication section 150 is formed of a reader and writer terminal that performs communication through near field radio communication (NFC) with the communication tag 36, and through the control performed by the control section 110, reads the cartridge information stored in the communication tag 36 and writes updated information when necessary.

There are various standards provided for the near field radio communication, and as long as non-contact communication over at least several centimeters to several tens of centimeters is possible, appropriate one of the standards may be set in accordance with specifications of the printer 100, use environment of the printer, configuration of the communication tag 36, etc.

The control section 110 is composed of a central processing unit (CPU), etc. and performs overall control including control in accordance with a print job (for example, control of an ink discharge amount in accordance with whether monochromatic or color printing is to be performed and feed and discharge control of paper serving as a printed medium) and the driving control of the various sections forming the printer 100.

Upon establishment of a state of communication between the communication tag 36 and the radio communication section 150, t control section 110 controls the radio communication section 150 to cause the radio communication section 150 to read the cartridge information stored in the communication tag 36. Then based on the cartridge information read via the radio communication section 150, the control section 110 performs the ink discharge control and the paper feed an discharge control in a manner such that the print processing in accordance with the print job is carried out.

Further, when the print processing has been carried out, to update the information which is included in the cartridge information stored in the communication tag 36 and which requires updating (for example, the ink remaining amount information and the empty information), the control section 110 acquires the information to be updated through, for example, predetermined calculation processing. Then the control section 110 controls the radio communication section 150 to overwrite (or newly write) the cartridge information to be updated in the communication tag 36.

[2. Overall Configuration of Ink Cartridge]

Figure 3A:
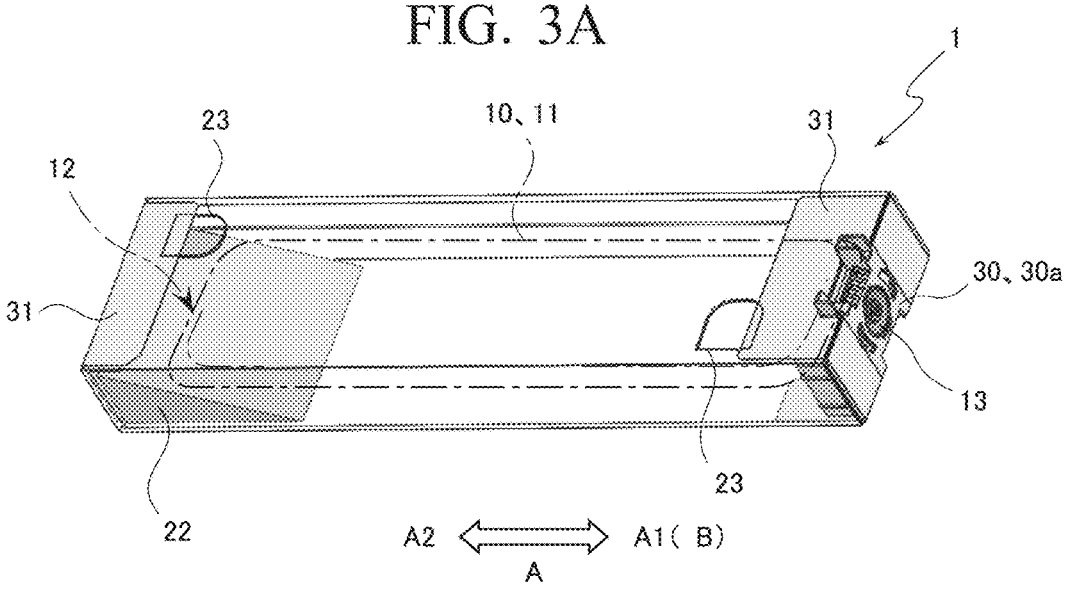
FIG. 3A is a schematic transparent view illustrating outer appearance and an inside of the same cartridge.
Figure 3B:
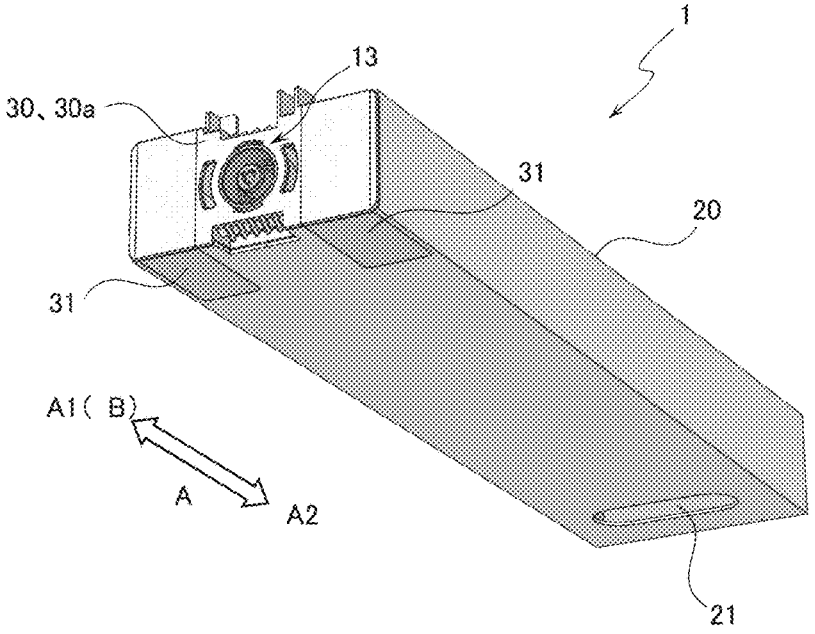
FIG. 3B is a schematic perspective view of the outer appearance of the same cartridge viewed from a rear.

Next, configuration of the ink cartridge 1 according to the present invention will be described. As illustrated in FIG. 3A or 3B, the ink cartridge 1 is a long and thin casing of a substantially rectangular parallelepiped shape that is attached to and detached from the printer 100 in the attaching/detaching direction A as a direction horizontal to the printer 100. The ink cartridge 1 includes: the ink container 10 formed of a thermoplastic film 11 filled with predetermined ink; the outer package 20 serving as an outer box into which the ink container 10 is inserted; and the engagement part 30 which is provided at a longitudinal one end of the ink container 10 and which engages with the cartridge attaching mechanism 130 of the printer 100.

<2-1. Ink Container>

The ink container 10 is a bag body in which the ink is sealed. In the present embodiment, the ink container 10 is formed by superposing two thermoplastic films 11 of a rectangular shape on each other with the ink supply section 13, to be described later on, placed therebetween at the longitudinal one end and then bonding together surroundings thereof through thermal welding. The ink container 10 is inserted through an opening part of the outer package 20 and the engagement part 30 assembled with the ink supply section 13 is fitted in the opening part to thereby fabricate the ink cartridge 1.

Figure 4A:
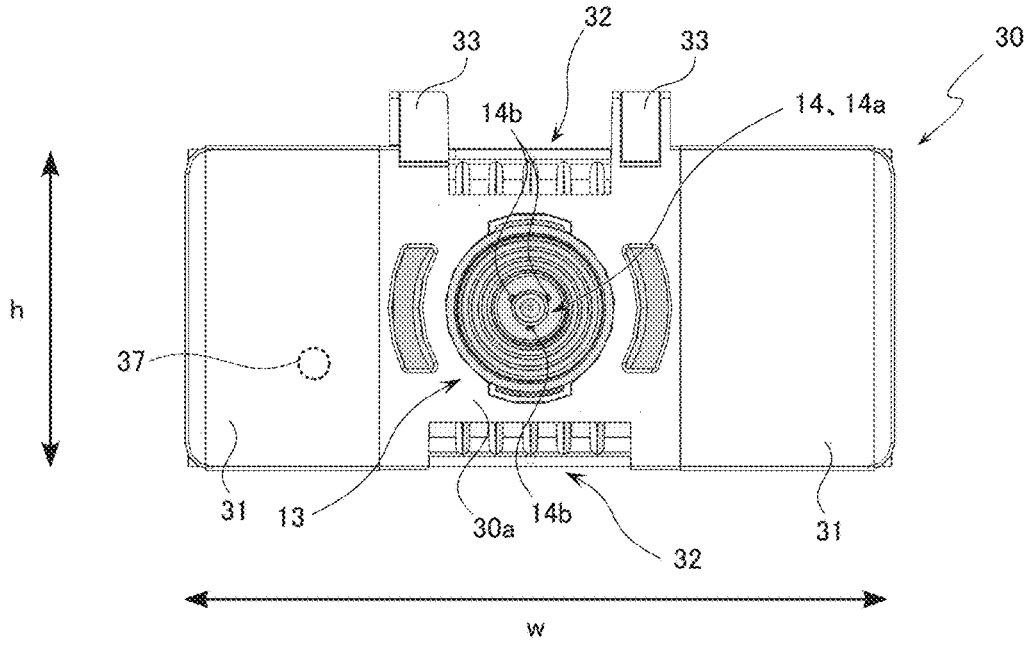
FIG. 4A is an elevation view of an engagement part of the same cartridge.

As illustrated in FIG. 4A, the ink supply section 13 which supplies ink filled in the container upon the loading of the ink cartridge 1 on the printer 100 is attached at an end part of the ink container 10 on a loading direction A1 side.

The ink supply section 13 is attached through thermal welding while placed at a predetermined section formed between the films 11 upon the fabrication of the ink container 10, and is assembled to the engagement part 30 in the aforementioned state.

Figure 4B:
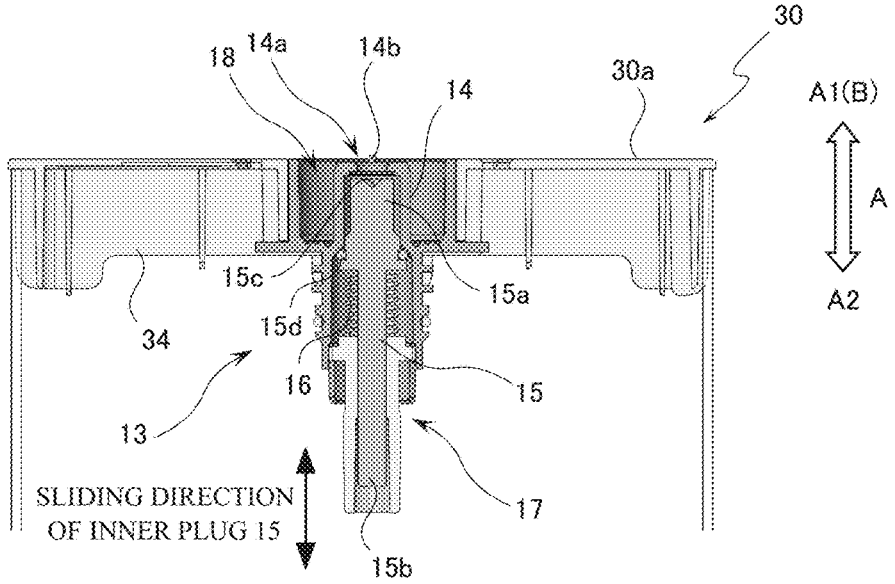
FIG. 4B is a schematic side sectional view of surroundings of the same engagement part on a partially enlarged scale.

Moreover, as illustrated in FIG. 4B on an enlarged scale, the ink supply section 13 is composed of: a supply opening 14 which engages with an engagement hole 35 of the engagement part 30 and which communicates an inside and an outside of the ink container 10 with each other; an inner plug 15 that opens or closes the communication of the supply opening 14; the biasing unit 16 that biases the inner plug 15 in the ink outflow direction B to close the supply opening 14; and a covering member 17 which guides sliding of the inner plug 15 along the attaching/detaching direction A following attachment and detachment of the ink cartridge 1 and also which covers and thereby protects a shaft portion of the inner plug 15 regardless of whether or not the sliding is performed.

In the present embodiment, before the loading of the ink cartridge 1 on the printer 100, the plug part 15*a* is pushed against an opening 14*a* by the biasing force of the biasing unit 16, whereby the plug part 15*a* closes the opening 14*a*, and also an O ring 15*d* fills a gap between the plug part 15*a* and the supply opening 14, so that the supply opening 14 turns into a closed state.

Upon the loading of the ink cartridge 1 on the printer 100, an engagement receiving part 15*c* provided at a tip of the plug part 15*a* engages with a pushing part (not illustrated) of the cartridge attaching mechanism 130. As a result, the plug part 15*a* is pushed against the biasing force of the biasing unit 16 and separates from the opening 14*a*, which therefore opens the supply opening 14, leading to a state in which the ink can outflow in the ink outflow direction B.

Provided around the supply opening 14 in the ink supply section 13 is a supply section side joint part 18 of a concave shape which is fitted in a holder side joint part, not illustrated, provided in the holder part 131.

Further, at a tip of the supply opening 14, a projected part 14*b* for properly adjusting an ink outflow amount at a fixed amount is provided by providing a slight gap between the opening 14*a* and the holder side joint part upon the loading of the ink cartridge 1 on the printer 100. In the present embodiment, as illustrated in FIG. 4A, three projected parts 14*b* are provided around the opening 14*a* at substantially equal intervals.

<2-2. Outer Package>

By bending a bending side set in a sheet member of paper (for example, a cardboard) and attaching together margins, the outer package 20 is formed into a bottomed box of a hollow rectangular parallelepiped shape with one longitudinal end open and another end thereof closed.

In the present embodiment, the opening part of the outer package 20 is formed into a rectangular shape such that a ratio between a horizontal side parallel to the horizontal plane including the attaching/detaching direction A of the ink cartridge 1 and a vertical side perpendicular to the horizontal plane is approximately 2 to 1. In other words, as illustrated in FIG. 3A, upon operation of attaching the ink cartridge 1 to the printer 100 in the loading direction A1, with the engagement part 30 on a printer 100 side being located at front, a ratio between a width w of the ink cartridge 1 and a height h thereof is approximately 2 to 1.

In the opening part (the opening part on the printer 100 side upon the cartridge loading) of the outer package 20, the engagement part 30 to be engaged with the cartridge attaching mechanism 130 on the printer 100 side is fitted, forming a surface abutting the cartridge attaching mechanism 130 of the printer 100.

Further, as illustrated in FIG. 3B, formed on a bottom surface of the outer package 20 is a concave part 21 which is to be pulled and which penetrates through a surface of the outer package 20. The concave part 21 is formed by providing a predetermined notch at a concave part forming section of the outer package 20 and bending the notched portion towards an inner surface side and a terminal end side on a member surface of the outer package 20.

At an inner terminal end of the outer package 20, the partition member 22 is arranged that ensures a form of an inner surface between the inner surface of the outer package 20 and the acuate outer surface of the terminal end part 12 of the ink container 10. The space ensured by the partition member 22 has a triangle side cross section and is also located at a position corresponding to a rear surface of the concave part 21 inside of the outer package 20.

In the present embodiment, part of the outer package 20 that is bent upon the formation of the concave part 21 is so notched as to be bent towards the terminal end side of the outer package 20 in a manner such that the aforementioned part is located in the inner space ensured by the partition member 22. For the partition member 22, for example, before closing the terminal end side, the partition member 22 may be inserted and assembled in a manner such as to be arranged at the terminal end of the outer package 20 to close the opening portion.

As described above, the partition member 22 is provided inside of the outer package 20 and the concave part 21 is provided on the surface of the outer package 20 in the ink cartridge 1. As a result, the user can pinch the concave part 21 at the terminal end of the outer package 20 and withdraw the ink cartridge upon operation of attaching and detaching the ink cartridge, which makes it easy to attach and detach the ink cartridge 1 and thus improves workability. Moreover, when the user pinches the 21 to attach and detach the ink cartridge 1, the user's hand does not make direct contact with the ink container 10, which can prevent breakage of the ink container 10 caused by contact by, for example, a user's finger or any accessary upon the cartridge attachment and detachment.

Further, the direction in which the ink container 10 is inserted into the outer package 20, the attaching/detaching direction A, and also the ink outflow direction B upon ink supply are located on the same axis, so that unnecessary stress on the outer package 20 is not generated, which can reduce possibilities that the attaching and detaching mechanism including, for example, the ink supply section 13 and the holder part 131 and the main body of the outer package 20 are broken.

As illustrated in FIG. 3A, a notch 23 for label removal is formed at a top surface of the outer package 20 in a manner such as to be superposed on an end part of a label 31 to be described later on. Part of the notch 23 is formed as a bending part and other parts thereof are broken, so that the notch 23 is formed on a surface side of the outer package 20 while connected to the outer package 20. When the notch 23 is pushed towards an inside by the finger pf the user, part of the outer package 20 is broken and bent while part of the label 31 is bonded. Therefore, the user can push the notch 23 to the inside of the outer package 20 with his or her finger and drag the label 31 and the outer package 20 away from each other while pinching the broken portion to thereby achieve removal together with part of the outer package 20 at which the label 31 has been broken, which permits simple performance of classification operation.

<2-3. Engagement Part>

The engagement part 30 is formed of a hard material such as resin or metal and an abutting surface 30*a* thereof abutting the holder part 131 is directed in the loading direction A, and functions as an attaching and detaching mechanism that is engaged with the holder part 131 upon the loading of the ink cartridge 1 on the printer 100. Moreover, the engagement part 30 engages with the opening part of the outer package 20, and is thus formed in a size almost equal to a dimension of the aforementioned opening part.

As illustrated in FIGS. 3A and 3B, after fitted in the opening part of the outer package 20, the engagement part 30 is firmly attached with the seal-like label 31 having viscosity on a rear surface thereof (for example, a sheet object having an adhesive applied to a rear surface of synthetic paper primarily consisting of synthetic resin such as film technique synthetic paper). In a state in which the engagement part 30 is engaged with the outer package 20, the label 31 is wound around from a side surface of the opening part of the outer package 20 across a side surface of the opening part on an opposite side through the abutting surface 30*a* of the engagement part 30 whereby the engagement part 30 is firmly assembled to the outer package 20.

Further, fit-in parts 32 that are fitted in a manner such as to be pinched by a pinching unit (not illustrated) provided on the printer 100 side are formed at a top and bottom of a center part of the engagement part 30. Convex parts of a triangle shape, which are fitted in the pinching unit provided at the holder part 131 of the printer 100, and they are arranged at the fit-in parts 32. The pinching unit has a mechanism of pinching a pair of concave parts at the top and the bottom in a manner such as to sandwich them with an elastic force, and the convex parts of the fit-in parts 32 are pushed in between concaved parts of the pinching unit whereby the fit-in parts 32 are fitted in with clicking feeling.

A pair of blocking convex part 33 is also projected from a top part of the engagement part 30. The blocking convex part 33 is provided at only one of end edges for avoiding erroneous recognition of the top and the bottom upon the cartridge attachment. Upon the fitting in the printer 100, the blocking convex part 33 is detected by an attachment detection sensor, not illustrated, provided on the printer 100 side. More specifically, the attachment detection sensor is an optical sensor such as a flood light and receiving light sensor, and through blockage of light reception, detects presence of an object blocked. The blocking convex part 33 is approached by the attachment detection sensor upon the attachment, and blocks the light reception by the sensor whereby the attachment is detected.

Figure 5A:
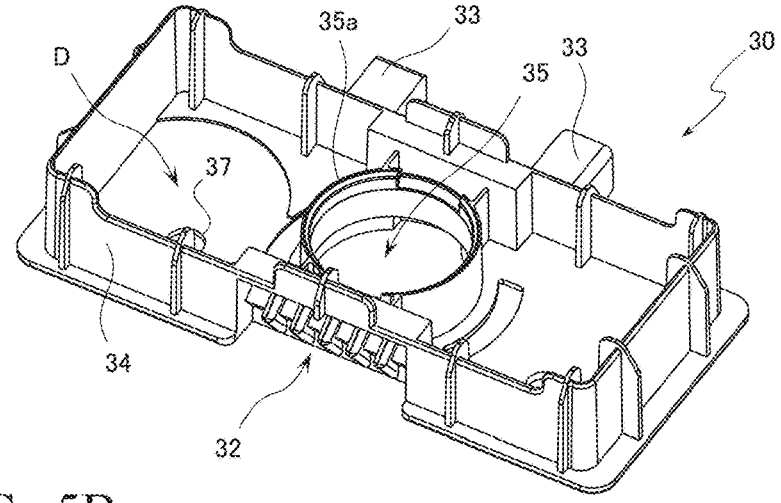
FIG. 5A is a schematic perspective view of an abutting surface serving as a surface of the engagement part viewed from the rear.
Figure 5B:
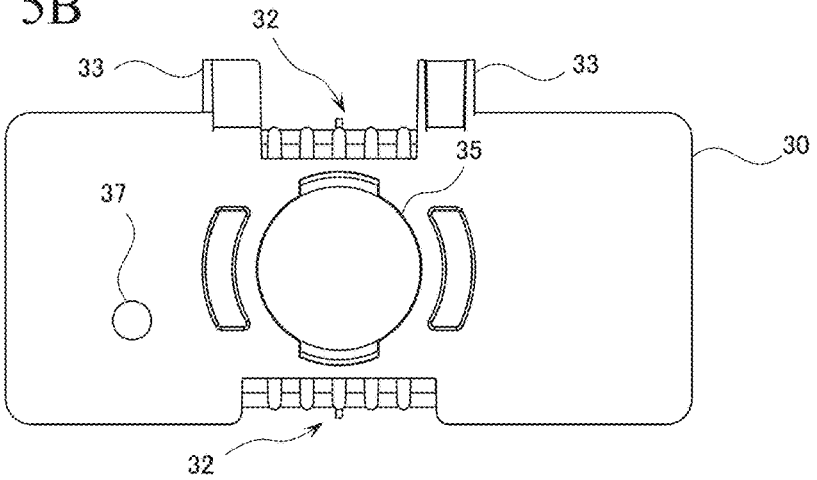
FIG. 5B is a schematic plan view of the engagement part viewed from an abutting surface side.
Figure 5C:
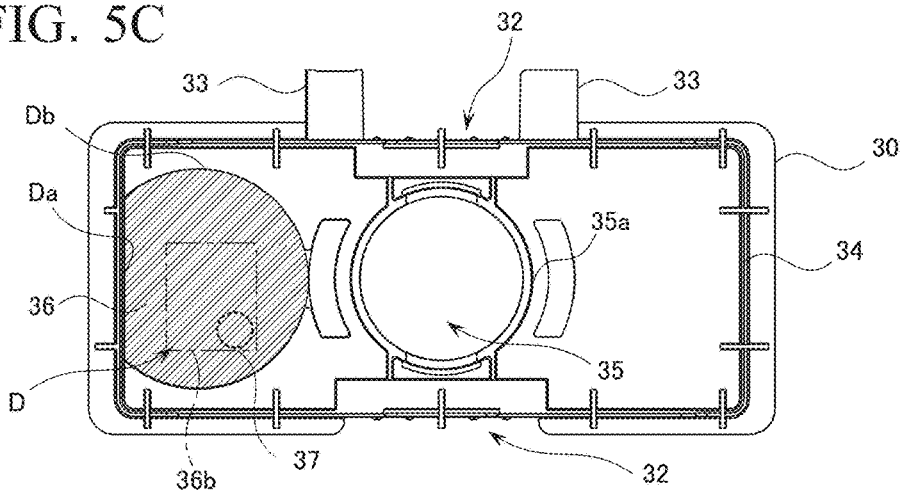
FIG. 5C is a schematic plan view of the engagement part viewed from the rear.

As illustrated in FIGS. 5A and 5C, a fit-in rib 34 is provided upright in the removing direction A2 at a circumferential edge on a rear side of an abutting surface 30*a* in the engagement part 30 abutting the holder part 131. The fit-in rib 34 is in charge of guiding upon the fit-in the opening part of the outer package 20 and preventing withdrawal from the outer package 20 after the fit-in.

Further, as illustrated in FIGS. 5B and 5C, formed at a substantially central portion of the engagement part 30 is the engagement hole 35 which engages with the supply opening 14 of the ink supply section 13 upon assembling of the ink supply section 13. In the present embodiment, a position at which the engagement hole 35 is formed with respect to the engagement part 30 is located at the substantially central portion of the engagement part 30, as illustrated in FIG. 5A.

At a circumferential edge of the engagement hole 35, an engagement rib 35*a* in charge of guiding upon the engagement of the supply opening 14 and holding the supply opening 14 after the engagement is provided upright at a similar height in the same direction as that of the fit-in rib 34 (the removing direction A2).

As illustrated in FIG. 5C, a bonding region D provided for bonding of a communication tag 36 that performs near field radio communication with the radio communication section 150 of the printer 100 is formed oppositely to the radio communication section 150 at a position horizontally adjacent to the engagement hole 35 on the rear side of the abutting surface 30*a* of the engagement part 30 (a position near a left end part of the engagement part 30 and between the aforementioned end part and the engagement hole 35 in the figure).

In the present embodiment, the bonding region D is formed in accordance with a shape of the bonded communication tag 36 (a hatched portion in FIG. 5C). Specifically, the bonding region D is formed into a shape of fish sausage (a substantially D shape) having: a chord part Da abutting a chord of the communication tag 36, to be described later on, and functioning as a positioning side for positioning the communication tag 36 upon the bonding thereof; and a circular arc part Db abutting a circular arc of the communication tag 36. As illustrated in FIG. 5C, the chord part Da is formed in a manner such as to be in contact with a base end of the fit-in rib 34 provided at the left end part of the engagement part 30. As a result, performing the bonding in a state in which the chord of the communication tag 36 is positioned with respect to the chord part Da permits proper bonding of the communication tag 36 to the bonding region D.

The communication tag 36 bonded to the bonding region D is composed of an radio frequency identification (RFID) tag having a coil pattern and an IC chip for electronic wave communication loaded on a substrate including a circular arc of, for example, over 180 degrees and a chord of the circular arc abutting the chord part Da. A bonding material (for example, a double-faced tape or a paste) is applied to an entire rear surface of the communication tag 36.

The communication tag 36 includes a storage unit 36*a* formed of a non-volatile memory storing various pieces of information required for executing the near field radio communication with the printer 100. The storage unit 36*a* also stores cartridge information as information required for improving user services provided upon use of the ink cartridge.

The cartridge information includes: for example, compatibility information (information specifying a model of a compatible printer), ink color information (color information of ink filled in the ink container 10), validated date information (information indicating guaranteed validated date of a product determined based on a manufacturing date of the ink container 10), ink remaining amount information (information indicating a remaining amount of the ink determined by subtracting a use amount of the ink from a total amount of the ink filled in the ink container 10), empty information (information indicating that the ink container 10 is empty when the ink in the ink container 10 has become equal to or less than a predetermined amount), protect information (information for making discrimination between an authentic product and a copycat product and preventing a failure of a printer as a result of use of the copycat product), reuse information (information indicating a number of times of reuse of the various components, such as the ink container, forming the ink cartridge), and traceability information (information of a manufacturer's plant and a distributer's store (sales office)). Upon detection of the loading on the cartridge attaching mechanism 130, the communication tag 36 starts the communication with the radio communication section 150 of the printer 100 and transmits data stored in the communication tag 36.

Adopted as a method for the communication made between the communication tag 36 and the radio communication section 150 according to the present embodiment is a passive method by which inner electric power is generated through reception of radio waves transmitted from the radio communication section 150, with the aforementioned electric power, data reading from and writing in the storage unit 36*a* in the IC chip are performed, and also data transmission and reception are performed through an antenna.

As the method for communication performed by the communication tag 36, instead of the passive method as in the present embodiment, an active method or a semi-active method may be adopted by way of changing the configuration of the printer 100 and the specifications of the communication tag 36. The communication tag 36 is formed into the shape of fish sausage including a circular arc and a chord as described above, but no limitations are placed on the aforementioned shape as long as the communication tag 36 is formed into such a size and shape that permits bonding thereof in a manner such as to cover a tag-removing hole 37, to be described later on, formed in the bonding region D on at least a rear side of the abutting surface 30*a* of the engagement part 30.

Further, ways of bonding the communication tag 36 may include bonding the tag itself directly to an inside of the bonding region D, and bonding the communication tag 36 to the bonding region D while sandwiching therebetween an adjusting member 36*b* having an adhesive region formed with an adhesive tape or an adhesive agent.

The adjusting member 36*b* is a member which is formed of such a material, for example, paper that can be so bent as to be adjustable to an appropriate size and which is provided for adjusting an arrangement position of the communication tag 36 in a manner such that, upon the near field radio communication between the printer 100 and the communication tag 36, the communication tag 36 is arranged at a most suitable distance therebetween and at a most suitable angle.

The ink cartridge 1 according to the invention can be reproduced by refilling ink in the ink container 10 to a predetermined amount, for example, upon a decrease of the ink below a predefined amount. Thus, upon the reproduction of the ink cartridge 1, the distance between the replaced communication tag 36 and the radio communication section 150 and the angles of communication can slightly be adjusted by using the adjusting member 36*b* in order to stabilize a state of the communication made between the replaced adjusting member 36*b* and the printer 100 on which the cartridge is loaded, which can therefore increase types of usable communication tags 36 and provide versatility.

Moreover, formed in the bonding region D is a tag-removing hole 37 for partially removing and floating the attached communication tag 36 from a bonding surface side thereof by inserting a bar-like member from an abutting surface 30*a* side. In the present embodiment, one tag-removing hole 37 is formed in the bonding region D but a plurality of tag-removing holes 37 may be formed.

With an ink cartridge disclosed as conventional art in Japanese Patent Application Laid-open No. 2010-82994, upon operation of discriminating a communication tag 36, a bar-like member is inserted from a tag-removing hole 37 to remove part of the communication tag 36 and then the removed and floated portion is pinched and fully removed. However, at a position of the tag-removing hole 37, the floated portion of the communication tag 36 is formed at a corner part of the engagement part, so that the fit-in rib 34 provided upright at the circumferential edge of an engagement surface interferes insertion of an operator's finger, resulting in difficulties in pinching the floated portion.

Thus, the tag-removing hole 37 of the ink cartridge 1 according to the invention meets the following two conditions as formation conditions in order to easily perform operation of discrimination between the engagement part 30 and the communication tag 36 upon disposal of the ink cartridge 1. Condition 1 is forming the tag-removing hole 37 at a position such that the floated portion obtained by removing and floating the communication tag 36 from the abutting surface 30*a* side with the bar-like member can easily be pinched. Condition 2 is locating the communication tag 36 at a position such that a great force is not applied and the tag itself is not damaged upon the insertion of the bar-like member when the communication tag 36 is removed and floated with the bar-like member since an entire rear surface of the communication tag 36 is bonded to the bonding region D in a relatively firm manner.

Here, a first embodiment of the tag-removing hole 37 formed at the engagement part 30 of the ink cartridge 1 of the invention will be described with reference to FIGS. 6A to 7D.

Description of Mode Examples "1 to 4" below will be given, as illustrated in FIGS. 6A to 6D, using an orthogonal coordinate system having two virtual lines X and Y as coordinate axes, where, in a plan view of a rear side of the engagement part 30, X represents the virtual line horizontally passing through a center O as an origin of a virtual circle VC (in a chain line) formed by linking together end parts of the circular arc part of the bonding region D and Y represents the virtual line passing through the center O in a direction orthogonal to the virtual line X (a vertical direction). In the orthogonal coordinate system, four regions obtained by partitioning with the virtual lines X and Y are defined in order counterclockwise from a top right: "a first quadrant", "a second quadrant", "a third quadrant", and "a fourth quadrant".

Further, areas of formation regions of the Mode Examples "1" to "4" below vary more or less depending on a diameter of the tag-removing hole 37, and thus are not limited to shapes and sizes of the formation regions illustrated in FIGS. 6A to 6D. In the figures, to clearly express the formation regions Ea to Ed, numerals for the various parts in the engagement part 30 are omitted.

Mode Example 1

Figure 6A:
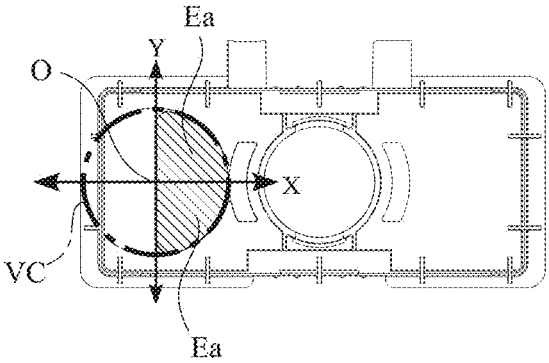
FIGS. 6A to 6D are views each illustrating a first embodiment of a formation region of a tag-removing hole formed at the engagement part.
Figure 6A:
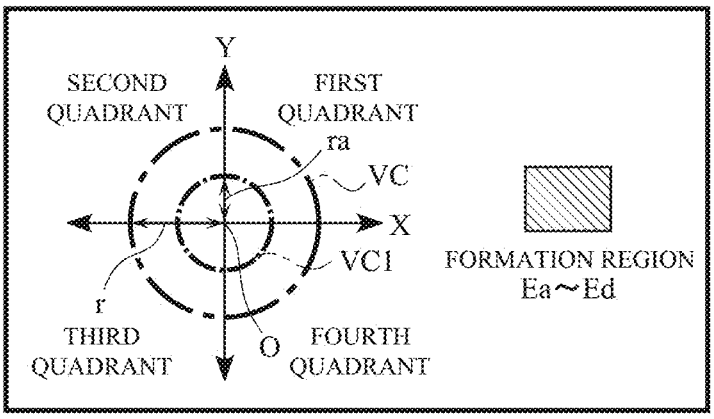

As illustrated in FIG. 6A, the formation region Ea of the tag-removing hole 37 defined in Mode Example 1 is a region which is located at the first and fourth quadrants included in the aforementioned four quadrants of the virtual circle VC partitioned with the virtual lines X and Y.

In Mode Example 1, upon removal of the communication tag 36, the tag-removing hole 37 is placed at a position located out of a center (a center of gravity) of the communication tag 36, on which a great force is applied as a result of the operation of inserting the bar-like member, and also located out of a corner part of the engagement part 30. Thus, an operator can easily insert his or her finger into the portion removed and floated by the bar-like member and can easily pinch the floated portion.

Mode Example 2

Figure 6B:
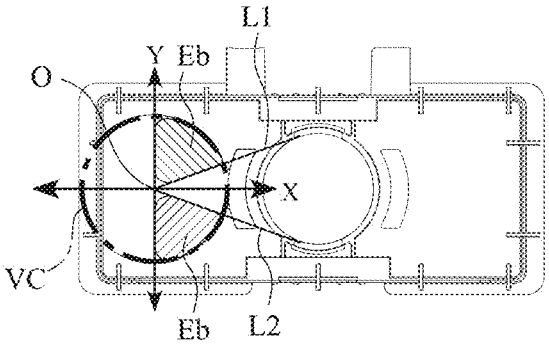
Figure 6B:
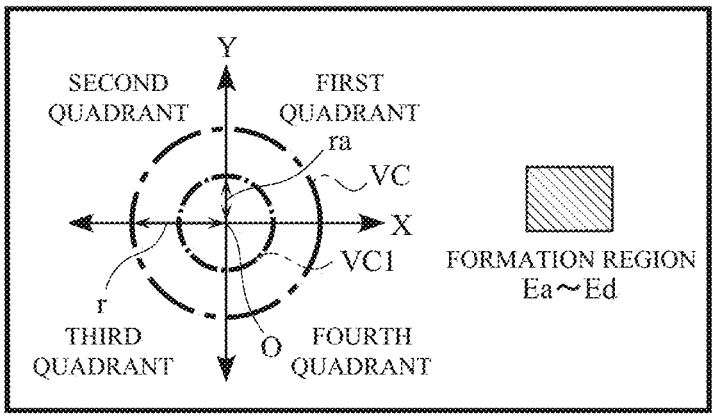

As illustrated in FIG. 6B, the formation regions Eb of the tag-removing hole 37 defined in Mode Example 2 are based on the formation region Ea of Mode Example 1. In Mode Example 2, two virtual lines linking together the center O of the virtual circle VC and a circumferential end of the engagement hole 35 are drawn, and one of the two virtual lines passing through circumference located on a first quadrant side from the center O is provided as L1 and another one of the virtual lines passing through circumference located on a fourth quadrant side from the center O is provided as L2. A region of the formation region Ea at the first quadrant located between the virtual line L1 and the virtual line Y and a region of the formation region Ea at the fourth quadrant located between the virtual line L2 and the virtual line Y are defined as formation regions of Mode Example 2. The tag-removing hole 37 itself is consequently formed in the formation regions Eb defined in Mode Example 2.

In a case where the tag-removing hole 37 is formed in the formation regions Eb defined in Mode Example 2, when the operator attempts to pinch a portion which is located out of the center (center of gravity) of the communication tag 36 and which is removed and floated with the bar-like member, part of the communication tag 36 can be floated at a position more distant from the engagement rib 35*a* than the tag-removing hole 37 formed in the formation region Ea, thus making it easy for the operator's finger to be inserted without making contact with the engagement rib 35*a*.

Mode Example 3

Figure 6C:
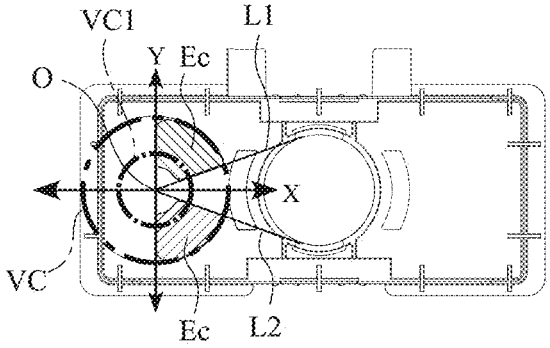
Figure 6C:
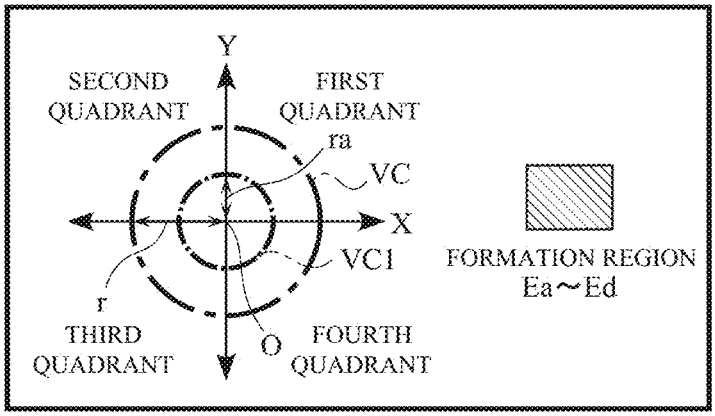

As illustrated in FIG. 6C, the formation regions Ec of the tag-removing hole 37 defined in Mode Example 3 are based on the formation regions Eb of Mode Example 2. The formation regions Ec of Mode Example 3 include: a region in which a hole center is arranged at circumference of a virtual circle VC1, which is concentric to the virtual circle VC and which is formed with a radius ra that is half of a radius r of the virtual circle VC, and a region located outwardly from the virtual circle VC1, which regions are included in the formation regions Eb located at the first and fourth quadrants. Therefore, the formation regions Ec defined in Mode Example 3 are consequently defined by the diameter of the tag-removing hole 37.

In a case where the tag-removing hole 37 is formed in the formation regions Ec defined in Mode Example 3, a position at which the communication tag 36 is removed is located on a more outer side than that in the formation regions Eb defined in Mode Example 2, thus making it easier to remove the communication tag 36 and also making it more easier to pinch a removed and floated portion.

Providing the tag-removing hole 37 at the center (center of gravity) of the communication tag 36 results in a risk of damaging the tag itself upon the tag removal with the bar-like member and also can cause a problem that a portion at which the removal starts is not fixed and the floating occurs at a position where the floated portion cannot easily be pinched. However, forming the tag-removing hole 37 in the formation regions Ec defined in Mode Example 3 results in the removal and floating of the part of the communication tag 36 at the position located out of the center (center of gravity) of the communication tag 36, thus avoiding the aforementioned problems.

Mode Example 4

Figure 6D:
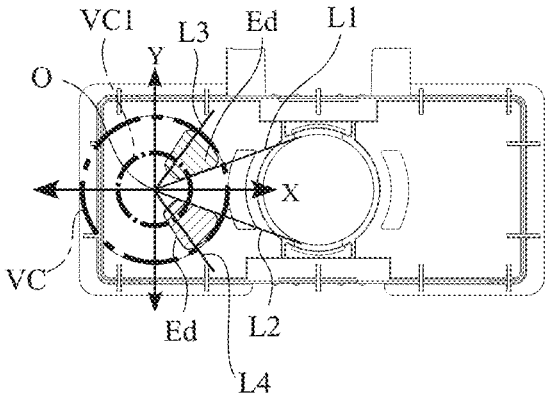
Figure 6D:
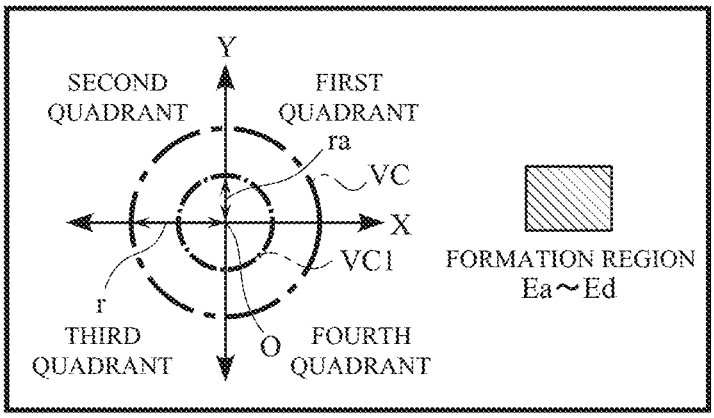

As illustrated in FIG. 6D, the formation regions Ed defined in Mode Example 4 are based on the formation regions Ec of Mode Example 3. First, a virtual line L3 is drawn from the center O towards the circumference of the virtual circle VC on the first quadrant side in a manner such as to equally divide (bisect) the first quadrant side of the formation region Ec. Moreover, a virtual line L4 is drawn from the center O towards the circumference of the virtual circle VC on the fourth quadrant side in a manner such as to equally divide (bisect) the fourth quadrant side of the formation region Ec. Then a region on a side partitioned by the virtual line L3 and the virtual line L1 in the formation region Ec on the first quadrant side, a region on a side partitioned by the virtual line L4 and the virtual line L2 in the formation region Ec on the fourth quadrant side, and a region in which the hole center is arranged on the virtual line L3 and the virtual line L4 are defined as the formation regions Ed. Therefore, the formation regions Ed defined in Mode Example 4 are consequently defined by the diameter of the tag-removing hole 37.

In a case where the tag-removing hole 37 is formed in the formation regions Ed defined in Mode Example 4, the position at which the communication tag 36 is removed is located more distant from the fit-in rib 34 than that in the formation regions Ec defined in Mode Example 3. Thus, compared to the tag-removing hole 37 in the formation regions Ec, the operator's finger hardly makes contact with the fit-in rib 34 and the engagement rib 35*a*, making it easier to pinch the portion floated as a result of removing the communication tag 36.

As described above, the formation regions Ea to Ed for forming the tag-removing hole 37 are formed in the first quadrant and the fourth quadrant located distant from the fit-in rib 34 provided upright at least on a short side of the engagement part 30 in a manner such as to meet the aforementioned two formation conditions. Thus, upon pinching the removed and floated portion of the communication tag 36, the floated portion separates from the corner part of the engagement part 30, thus making it easy to insert the operator's finger.

In order of the formation regions Ea→Eb→Ec→Ed, the position at which the tag-removing hole 37 is formed is located more distantly from the center (center of gravity) and also located more distantly from the fit-in rib 34 and the engagement rib 35*a*. Thus, the communication tag 36 can be removed with a smaller force, and also the removed and floated portion can easily be pinched. Therefore, of the formation regions Ea to Ed indicated in Mode Examples 1 to 4 described above, the formation regions Ed are most optimum positions as the regions where the tag-removing hole 37 is formed.

Figures 7A, 7B:
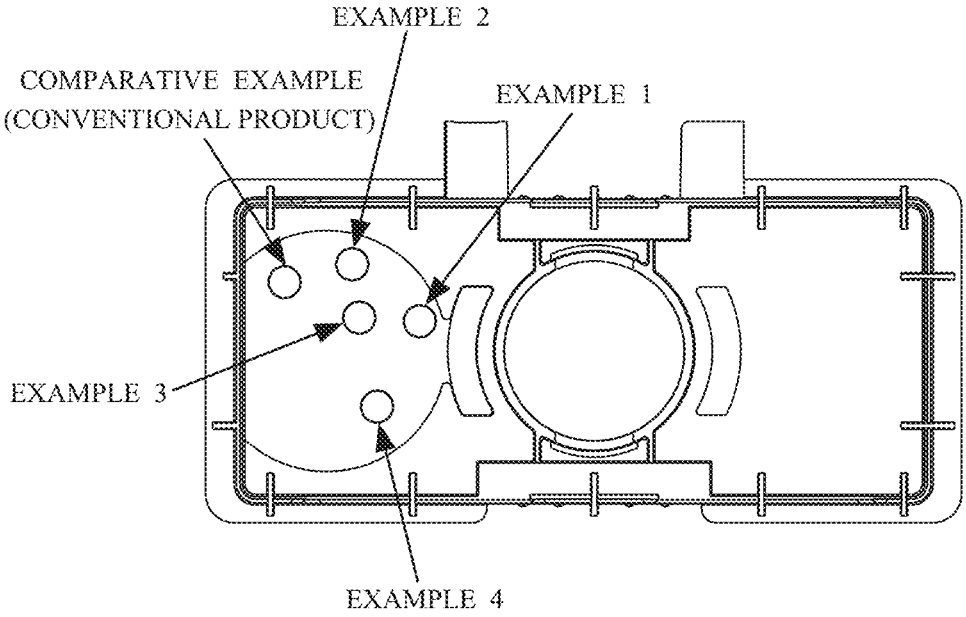
FIG. 7A is a view illustrating hole formation positions when comparative evaluation between a conventional tag-removing hole and the tag-removing holes formed in formation regions Ea to Ed is performed.
FIG. 7B is a table illustrating results of the comparative evaluation.

Next, comparative evaluation of the tag-removing hole 37 formed in the formation regions Ea to Ed described above will be described with reference to FIGS. 7A and 7B. In the comparative evaluation below, as illustrated in FIG. 7A, a position at which a tag-removing hole of a conventional product is formed is provided as "Comparative Example", a position of the tag-removing hole 37 formed in the formation region Ea defined in Mode Example 1 above is provided as "Example 1", a position of the tag-removing hole 37 formed in the formation regions Eb defined in Mode Example 2 is provided as "Example 2", a position of the tag-removing hole 37 formed in the formation regions Ec defined in Mode Example 3 is provided as "Example 3", and a position of the tag-removing hole 37 formed in the formation regions Ed defined in Mode Example 4 is defined as "Example 4". The evaluation was performed based on "a removal degree" and "a pinching degree" provided as degrees indicating how easily the removal of the communication tag 36 is performed.

Here, the "removal degree" is a result obtained inserting a ball driver (manufactured by VESSEL CO., INC. "P1-140") as the bar-like member from the tag-removing hole 37, measuring, with a push-pull gauge (manufactured by AIKOH ENGINEERING CO., INC. "MODEL series 9500"), an N value required for providing a state in which part of the communication tag 36 is removed and floated, and performing evaluation based on a reference value 15N serving as a border. As evaluation results, a value less than 15N is marked with "○", a value equal to or larger than 15N is marked with "Δ", and when the communication tag 36 was broken, "X" was provided. The value "15N" used as a reference value upon the evaluation of the removal degree represents a value excess over which the communication tag 36 is broken as a result of great projection of the bar-like member (driver) by an excessive force resulting from the removal when the bar-like member is stuck.

The "pinching degree" represents results of performing relative evaluation of easiness in pinching with fingers of a plurality of experimenters. As evaluation results, a position determined such that the part of the communication tag 36 floated as a result of inserting the bar-like member from the tag-removing hole 37 can be pinched without the experimenter's finger making contact with the fit-in rib 34 and the engagement rib 35*a* located around the tag-removing hole 37 is marked with "○" where the pinching degree is highest, a position determined such that the pinching can be performed with the experimenter's finger making contact with only either one of the fit-in rib 34 and the engagement rib 35*a* located around the tag-removing hole 37 is marked with "Δ" where the pinching degree is lower than that of "○", and a position determined such that the pinching needs to be performed with the experimenter's finger making contact with two or more portions including the fit-in rib 34 and the engagement rib 35*a* located around the tag-removing hole 37 is marked with "X" where the pinching degree is lowest.

As illustrated in FIG. 7B, the results of comparison between Examples 1 to 4 and Comparative Example show no great difference therebetween in terms of the removal degree. However, in terms of the pinching degree, high evaluation was provided in Mode Examples 1 to 4 while Comparative Example was provided with "X". That is, like the invention, it was verified that the communication tag 36 can more easily be removed than that of a conventional product as long as the tag-removing hole 37 is formed in any of the formation regions Ea to Ed defined in Mode Examples 1 to 4 described above.

Next, a second embodiment of the tag-removing hole 37 formed at the engagement part 30 of the ink cartridge 1 of the invention will be described with reference to FIGS. 8A to 9B.

The tag-removing hole 37 according to the second embodiment is formed below the communication tag 36 (that is, a region covered by the communication tag 36) formed into a desired shape (for example, a polygonal, circular, or oval shape) bonded between the fit-in rib 34 and the engagement rib 35*a* in the engagement part 30.

Figure 8A:
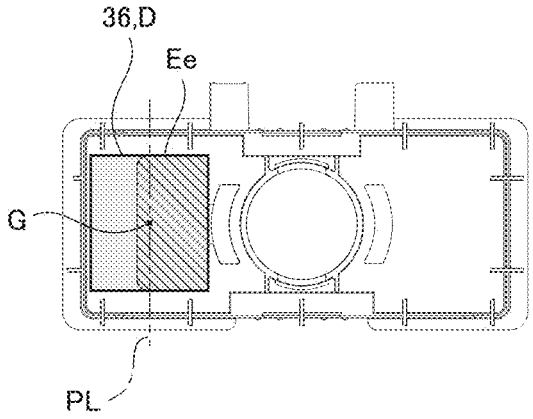
FIGS. 8A and 8B are views each illustrating a second embodiment of a formation region of the tag-removing hole formed at the engagement part of the same cartridge.
Figure 8B:
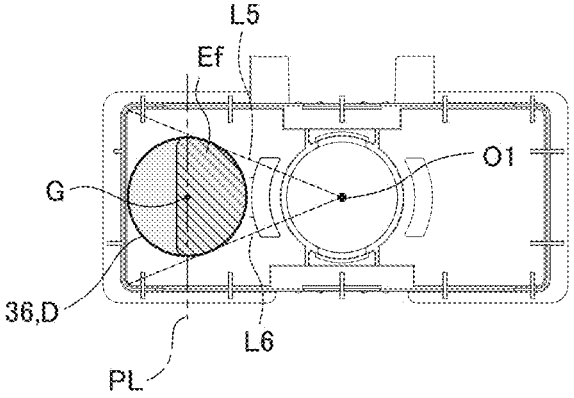

On a rear side of the engagement part 30, a region to which the communication tag 36 is bonded is provided as the bonding region D. Specifically, in the embodiment described above, the bonding region D is formed in accordance with the shape of the communication tag 36 to make the bonding region D functions as a guide for the bonding of the communication tag 36, but in the present embodiment, to support even the communication tag 36 formed into a desired shape, the bonding region D is not formed at the engagement part 30, and a region to which at least the communication tag 36 bonded between the fit-in rib 34 an the engagement rib 35*a* in the engagement part 30 is bonded is provided as the bonding region D. Therefore, in the present embodiment, in case of the communication tag 36 of a rectangular shape as illustrated in FIG. 8A, the bonding region D is also formed into the same rectangular shape. In case of the communication tag 36 of a circular shape as illustrated in FIG. 8B, the bonding region D is also formed into the same circular shape. The shapes and sizes of the communication tags 36 illustrated in FIGS. 8A and 8B are each just one example, and the shapes and the sizes can be designed as desired.

Mode Example 5

As illustrated in FIG. 8A, for a formation region Ee defined in Mode Example 5, for example, relative to the bonding region D of the rectangular shaped communication tag 36, a virtual perpendicular line PL is drawn which passes through a center of gravity G of the communication tag 36 and which forms a right angle with the fit-in rib 34 provided on a long side of the engagement part 30. Then of the bonding region D partitioned by the virtual perpendicular line PL, a region located on an engagement rib 35*a* side is provided as the formation region Ee. As illustrated in FIG. 8A, the tag-removing hole 37 is only required to be at least partially located more closely to the engagement rib 35*a* than a position of the center of gravity G, and thus is so formed as to become wider by an amount corresponding to a substantially total size of the hole towards the fit-in rib 34 on a short side than the region partitioned by the virtual perpendicular line PL. That is, a shape and a position of the formation region Ee are defined depending on the shape and bonded position of the communication tag 36 and the diameter of the tag-removing hole 37.

In a case where the tag-removing hole 37 is formed in the formation region Ee defined in Mode Example 5, the hole is formed at the position more closer to the engagement rib 35*a* than the center of gravity G of the communication tag 36. Thus, upon the removal and floating of the part of the communication tag 36 formed into a desired shape, the floating can be performed at a portion distant from the corner part of the engagement part 30 and the fit-in rib 34, thus making it easy for the operator to insert his or her finger in the portion removed and floated by the bar-like member and pinch the floated portion.

Mode Example 6

A formation region Ef defined in Mode Example 6 is based on the formation region Ee defined in Mode Example 5. As illustrated in FIG. 8B, for the formation region Ef of Mode Example 6, virtual lines L5 and L6 are first drawn which link together a center O1 of the engagement hole 35 and a corner part at which the fit-in rib 34 on a short side and the fit-in rib 34 on a long side intersect each other and which is located on a side where the communication tag 36 is bonded. Then a region partitioned by the virtual lines L5 and L6 in the formation region Ee is provided as the formation region Ef. As illustrated in FIG. 8B, at least part of the tag-removing hole 37 may be located more closely to the engagement rib 35*a* than a position of the center of gravity G, and is thus so formed as to become wider by an amount corresponding to a substantially total side of the hole towards the fit-in rib 34 on the short side than the region partitioned by the virtual perpendicular line PL. That is, the size and position of the formation region Ee are defined depending on the shape and bonding position of the communication tag 36 and the diameter of the tag-removing hole 37.

A position in the formation region Ef defined in Mode Example 6 at which the communication tag 36 is removed is located at a position which is more adequately distant from the fit-in rib 34 and the engagement rib 35*a* than the formation region Ee defined in Mode Example 5 and which is located where a gap between the ribs is provided, thus making it easier to remove the communication tag 36 and also enlarging the floated portion, which makes it easier to pinch the removed and floated portion.

As described above, as a result of forming the tag-removing hole 37 in the formation regions Ee and Ef described above, the hole is formed at a position closer to the engagement rib 35*a* than a position of the center of gravity G of the communication tag 36. Thus, when the bar-like member is inserted in the tag-removing hole 37 formed at a position covered by the communication tag 36 to remove and float the tag, the finger can easily be inserted, which makes it possible to easily pinch the floated portion as is the case with Mode Examples 1 to 4.

Figures 9A, 9B:
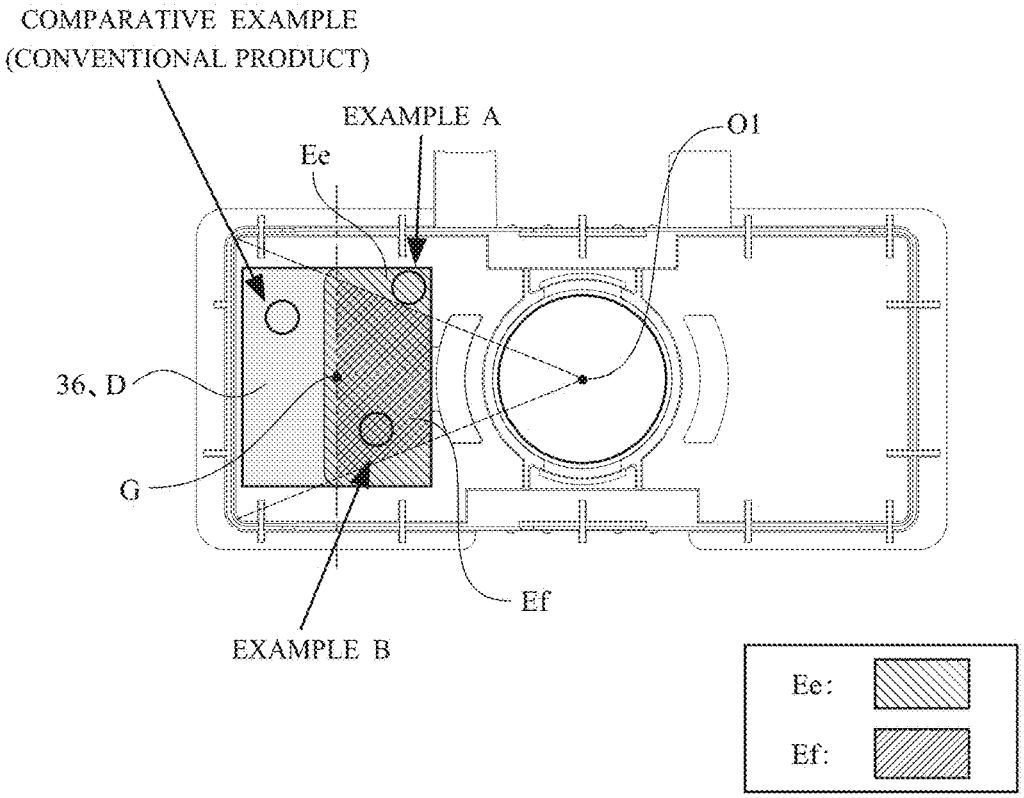
FIG. 9A is a view illustrating hole formation positions when comparative evaluation between a tag-removing hole of a conventional product and the tag-removing holes formed in formation regions Ee and Ef is performed by using a communication tag of a rectangular shape.
FIG. 9B is a table illustrating results of the comparative evaluation.
Figures 10A, 10B:
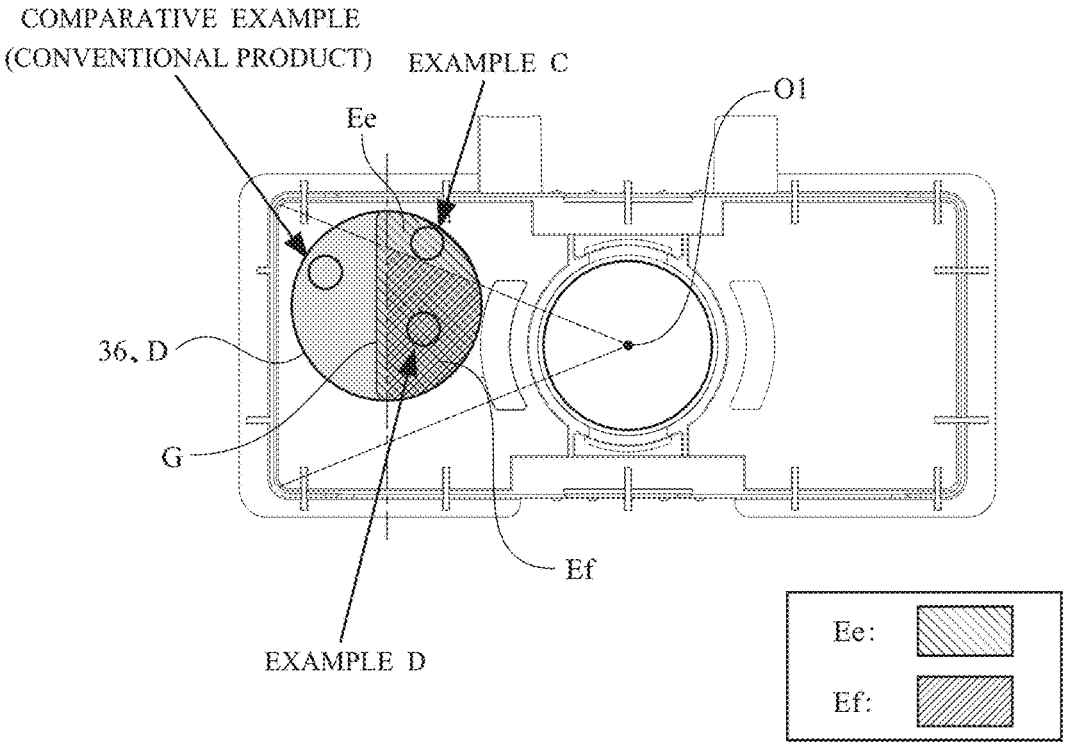
FIG. 10A is a view illustrating hole formation positions when comparative evaluation between the tag-removing hole of the conventional product and the tag-removing holes formed in the formation regions Ee and Ef is performed by using a communication tag of a circular shape.
FIG. 10B is a table illustrating results of the comparative evaluation.

Next, comparative evaluation of the tag-removing holes 37 formed in the formation regions Ee and Ef described above will be described with reference to FIGS. 9A to 10B. In the comparative evaluation below, as illustrated in FIGS. 9A and 10A, a position of the tag-removing hole of a conventional product is provided as "Comparative Example", where a position of the tag-removing hole 37 formed in the formation region Ee defined in Mode Example 5 described above is provided as "Example A", and a position of the tag-removing hole 37 formed in the formation region Ef defined in Mode Example 6 is provided as "Example B", the evaluation was performed based on "a removal degree" and "a pinching degree" as degrees indicating how easily the communication tag 36 is removed. A shape of the communication tag 36 in the present examples is a rectangular shape, and the same evaluation criterion as described above in "Mode Examples 1 to 4" were provided for "the removal degree" and "the pinching degree".

As illustrated in FIG. 9B, results of the comparison between Examples A and B and Comparative Example show no great difference therebetween in terms of the removal degree. However, in terms of the pinching degree, substantially high evaluations were provided in Mode Examples A and B while "X" is provided in Comparative Example. That is, as is the case with the invention, it was verified that as long as part of the tag-removing hole 37 is formed in either of the formation regions Ee and Ef defined in Mode Examples 5 and 6 described above, the communication tag 36 can more easily be removed than that of the conventional product.

As illustrated in FIG. 10B, results of comparison between Examples C and D show no great difference therebetween in terms of the removal degree. However, in terms of the pinching degree, substantially high evaluations were provided for Examples C and D while "X" was provided for Comparative Example. That is, as is the case with the invention, it was verified that as long as part of the tag-removing hole 37 is formed in either of the formation regions Ee and Ef defined in Mode Examples 5 and 6 described above, the communication tag 36 can more easily be removed than that of the conventional product.

[3. Ink Cartridge Reproduction Method]

Next, process steps applied upon the reproduction of the ink cartridge 1 provided with the aforementioned configuration will be described.

Illustrated in a step example below is a series of flows by which the ink container 10 of the invention is collected by the operator and the collected ink container 10 is reused to reproduce an ink cartridge 1.

<3-1. Configuration of Ink Refill Device>

In the method for reproducing the ink cartridge 1 according to the invention, a predetermined amount of ink is refilled with an ink refill device 200 that refills ink in the ink container 10.

Figure 11:
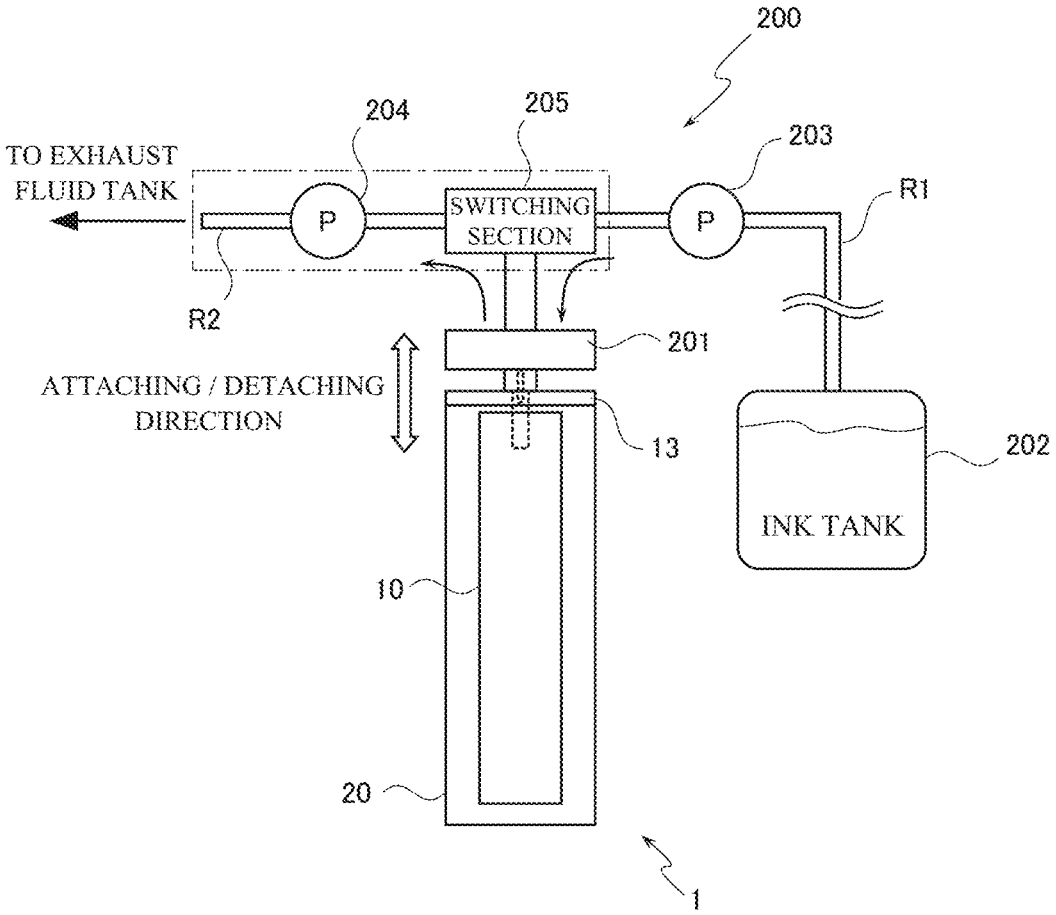
FIG. 11 is a view illustrating device configuration of an ink refill device in ink cartridge reproduction.

As illustrated in FIG. 11, the ink refill device 200 includes: a supply section 201 that is fitted in a supply opening 14 of the recycled ink container 10 to open the supply opening 14; an ink tank 202 that stores ink to be refilled; a delivery pump 203 that delivers the ink stored in the ink tank 202 to the ink container 10; and a refill ink flow path R1 that serves as an ink flow path formed between the ink container 10 and the ink tank 202 via the delivery pump 203.

In case of configuration such that new ink is refilled in a state in which the ink remaining in the ink container 10 has been removed to make the ink container 10 empty, configuration surrounded by a chain line in the figure is added. Specifically, the configuration includes: a suction pump 204 that suctions the ink remaining in the ink container 10 and then delivers the ink to an exhaust fluid tank, not illustrated; and a switching section 205 formed of a switching valve that, in accordance with ink refill and exhaust processing, switches between a refill ink route R1 formed between the delivery pump 203 and the supply section 201 and an exhaust ink path R2 formed between the suction pump 204 and the supply section 201.

With such configuration, upon ink refill and ink exhaust, the delivery pump 203, the suction pump 204, and the switching section 205 may appropriately be controlled at predetermined timing to perform the ink exhaust processing and the ink refill processing.

<3-2. Steps of Reproduction>

In the first process step taken upon the reproduction of the ink cartridge 1 according to the present invention, the operator collects the ink cartridge 1 from the printer 100, and disassembles the outer package 20 of the collected ink cartridge 1 to take out the ink container 10.

Next, the step of removing the communication tag 36 from the engagement part 30 fitted with the ink container 10 taken out is performed. Since the tag-removing hole 37 is so formed as to be superposed on the communication tag 36 in any of the formation regions Ea to Ef defined in Mode Examples 1 to 6 described above, the operator can insert the bar-like member in the tag-removing hole 37 from the abutting surface 30*a* side to thereby remove and float part of the communication tag 36 bonded to the engagement part 30 and pinch and remove (eliminate) the removed and floated portion.

Next, the step of refilling a predetermined amount of ink with the supply section 201 of the ink refill device 200 and the supply opening 14 of the ink container 10 fitted in each other is performed. Through the fit-in operation, the plug part 15*a* of the inner plug 15 is pushed against the biasing force of the biasing unit 16 and thus the plug part 15*a* separates from the opening 14*a* to open the supply opening 14, thus permitting ink supply.

An amount of the ink refilled in the ink container 10 is defined by the specifications of the ink cartridge 1 to be reproduced, and thus it is not necessarily required to refill a defined amount (for example, an amount of ink when fully filled) of ink in the ink container 10. For example, reducing the defined amount of ink to half make it possible to sell the ink at a low cost in accordance with an amount of ink reduced, and thus upon reproduction of the ink cartridge 1, the amount of ink refilled may be reduced to half of the defined amount. Moreover, in a case where the ink remains in the ink container 10, ink may be refilled to reach the predetermined amount from the aforementioned state.

Upon ending of the ink refill step, a replacement communication tag 36 storing new cartridge information indicating the specifications of the ink cartridge 1 reproduced is bonded to a predetermined portion of the engagement part 30.

In a case where the tag-removing hole 37 is formed in the formation regions Ea to Ed described above, the communication tag 36 is bonded at a position superposed on the tag-removing hole 37 in the bonding region D formed in the engagement part 30. In a case where the tag-removing hole 37 is formed in the formation region Ee or Ef, the communication tag 36 is bonded between the fit-in rib 34 and the engagement rib 35*a*.

Further, cartridge information based on the specifications of the reproduced ink cartridge 1 to be bonded is newly stored in the replacement communication tag 36.

Upon the bonding of the replacement communication tag 36 to the engagement part 30, a new outer package 20 is assembled and the ink container 10 is inserted and stored into the assembled outer package 20, and then the label 31 is attached and fixed, upon which the steps of reproducing the ink cartridge 1 ends. In a case where the air remains in the container depending on the amount of ink refill, a side surface of the container is preferably pushed to achieve a state in which the air was removed from the supply opening 14.

In the reproduction method described above, upon the step of ink refill, ink of the same color and component as ink used before the refill was refilled to prevent mixture of another ink, but the collected ink container 10 can also be once washed to refill another ink.

To perform the refill after disposal of the ink stored ion the ink container 10, an ink refill device 200 having configuration indicated by the chain line illustrated in FIG. 11 is used. Since an ink exhaust step is performed before the ink refill step, the switching section 205 is controlled to switch the ink path to the exhaust ink path R2, and then the suction pump 204 is controlled to withdraw the ink remaining in the ink container 10. Then providing a state in which the ink container 10 is empty, the switching section 205 is controlled to switch the ink path to the refill ink path R1, in which state the delivery pump 203 is controlled to refill a predetermined amount of new ink in the ink container 10 whereby the ink cartridge 1 is reproduced.

Preferably, in a case where the air remains in the container depending on the amount of ink refill, the switching section 205 is controlled to switch the ink path to the exhaust ink path R2 and only the air or the air with a slight amount of ink are simultaneously suctioned by the suction pump 204 to provide a state in which only the ink is contained in the container.

As described above, with the method for reproducing the ink cartridge 1 described above, the use of the replacement communication tag 36 storing the cartridge information based on the specifications of the ink cartridge 1 to which the communication tag 36 is bonded no longer require complicated processing of rewriting cartridge information stored in the already used communication tag 36 and permits easy reproduction of the ink cartridge 1.

In the engagement part 30, the region in the bonding region D located in the first and fourth quadrants in the orthogonal coordinate system having, as the coordinate axes, the virtual lines X and Y having an origin at the center O of the virtual circle VC formed by linking together the ends parts of the circular arc part of the bonding region D is provided as the formation region Ea and the tag-removing hole 37 is formed in the formation region Ea. Thus, when the tag-removing hole 37 comes out of the center (center of gravity) of the communication tag 36 and the bar-like member is inserted from the tag-removing hole 37 to remove the communication tag 36, a portion located out of the corner part of the engagement part 30 where the operator's finger can easily be inserted is floated and then pinched and removed.

Since the tag-removing hole 37 is formed at the position closer to the engagement rib 35*a* than the center of gravity G of the communication tag 36, upon removal and floating of part of the communication tag 36 formed into a desired shape, the floating can be performed at a portion distant from the corner part of the engagement part 30 and the fit-in rib 34, and the operator can easily insert his or her finger in the portion floated by removing the bar-like member and can easily pinch the floated portion.

As a result of placing the adjusting member 36*b* on a side on which the communication tag 36 is bonded, upon the reproduction of the ink cartridge 1, a communication distance and a communication angle between the communication tag 36 and the radio communication section 150 can slightly be adjusted so as to stabilize a state of communication between the replaced communication tag 36 and the printer 100 on which the cartridge is loaded, thus resulting in an increase in types of usable communication tags 36, which can provide versatility.

Loading the ink container 10 provided with a replacement communication tag 36 as a replacement component onto a newly assembled outer package 20 without recycling the used outer package 20 which is, for example, contaminated with ink, rubbed, or bent upon usage thereof can provide the reproduced product with the same level of quality as that of a new product.

REFERENCE SIGNS LIST

1 . . . ink cartridge
10 . . . ink container
11 . . . thermoplastic film
12 . . . terminal end part
13 . . . ink supply section
14 . . . supply opening (14*a* . . . opening, 14*b* . . . projected part)
15 . . . inner plug (15*a* . . . plug part, 15*b* . . . shaft part, 15*c* . . . engagement receiving part, 15*d* . . . O ring)
16 . . . biasing unit
17 . . . covering member
18 . . . supply section side joint part
20 . . . outer package
21 . . . concave part
22 . . . partition member
23 . . . notch
30 . . . engagement part (30*a* . . . abutting surface)
31 . . . label
32 . . . fit-in rib
33 . . . fit-in part
34 . . . blocking convex part
35 . . . engagement hole (35*a* . . . engagement rib)
36 . . . communication tag (36*a* . . . storage unit, 36*b* . . . adjusting member)
37 . . . tag-removing hole
100 . . . printer (100*a* . . . device body)
110 . . . control section
120 . . . setting operation section
130 . . . cartridge attaching mechanism
131 . . . holder part
140 . . . top device
150 . . . radio communication section
200 . . . ink refill device
201 . . . supply section
202 . . . ink tank
203 . . . delivery pump
204 . . . suction pump
205 . . . switching section
A . . . attaching/detaching direction (A1 . . . loading direction, A2 . . . removing direction)
B . . . ink outflow direction
D . . . bonding region (Da . . . chord part, Db . . . circular arc part)
Ea to Ef . . . formation region of tag-removing hole
L1 to L6, X, Y . . . virtual line
PL . . . virtual perpendicular line
VC, VC1 . . . virtual circle
r, ra . . . radius of virtual circle
O . . . center of a virtual circle
O1 . . . center of engagement hole
R1 . . . refill ink flow path
R2 . . . exhaust ink path

The invention claimed is:

1. An ink cartridge comprising:

an ink container;

a communication tag bearing cartridge information including ink information related to ink filled in the ink container;

an engagement part configured to engage with a printer provided with a function of reading the cartridge information and supplying ink to the ink container;

a tag-removing hole formed at a position located out of a corner part of the engagement part, the tag-removing hole being formed through the engagement part;

the communication tag being bonded to the engagement part in a manner so as to be partially superposed on the tag-removing hole; and wherein the communication tag is partially superposed on an empty tag-removing hole.

2. The ink cartridge according to claim 1, wherein:

the engagement part is fitted in an opening part of a new outer package in which the ink container is stored.

3. The ink cartridge according to claim 1, wherein:

the tag-removing hole is further formed at a position located out of a center of gravity of the communication tag bonded to the engagement part.

4. The ink cartridge according to claim 1, further comprising:

an engagement hole formed at a substantially central portion of the engagement part;

an engagement rib provided upright at a circumferential edge of the engagement hole;

the tag-removing hole being formed at a position more distant from the engagement rib.

5. The ink cartridge according to claim 1, further comprising:

an outer package;

the engagement part further comprising:

a fit-in rib formed at a circumferential edge of a body;

an engagement hole formed at a substantially central portion of the body and engaging with a supply opening communicating together an inside and an outside of the ink container stored in the outer package having an opening of a rectangular shape;

an engagement rib provided upright at a circumferential edge of the engagement hole in the same direction as a direction of the fit-in rib;

a bonding region for bonding the communication tag, the bonding region being formed of a chord part and a circular arc part and formed in a state in which the chord part is in contact with a base end of the fit-in rib on a short side at a position horizontally adjacent to the engagement hole; and the tag-removing hole being formed in a formation region Ea as a region within the bonding region located in a first quadrant and a fourth quadrant obtained upon partitioning with an orthogonal coordinate system having, as coordinate axes, a virtual line X and a virtual line Y, the virtual line X passing through, as an origin, a center O of a virtual circle VC formed by linking together ends part of the circular arc part of the bonding region and positively directing a direction parallel to a long side of the engagement part and approaching the engagement rib, the virtual line Y passing through the center O in a direction orthogonal to the virtual line X.

6. The ink cartridge according to claim 5, wherein:

the tag-removing hole is formed in formation regions Eb including: a region located in the formation region Ea in the first quadrant and between a virtual line L1 drawn from the center O of the virtual circle VC to the circumferential edge of the engagement hole through circumference on a first quadrant side and the virtual line Y; and a region located in the formation region Ea in the fourth quadrant and between a virtual line L2 drawn from the center O of the virtual circle VC to the circumferential edge of the engagement hole through circumference on a fourth quadrant side and the virtual line Y.

7. The ink cartridge according to claim 6, wherein:

when a virtual circle VC1 concentric to the virtual circle VC is formed with a radius ra that is half of a radius r of the virtual circle VC, the tag-removing hole is formed in formation regions Ec that are included in the formation regions Eb located in the first quadrant and the fourth quadrant and that include a region in which a hole center is arranged on a circumference of the virtual circle VC1 and a region located on an outer side than the virtual circle VC1.

8. The ink cartridge according to claim 7, wherein:

a virtual line L3 is drawn from the center O towards the circumference on the first quadrant side in the virtual circle VC in a manner such as to equally divide the first quadrant side of the formation region Ec, a virtual line 4 is drawn from the center O towards the circumference on the fourth quadrant side in the virtual circle VC in a manner such as to equally divide the fourth quadrant side of the formation region Ec; and the tag-removing hole is formed in formation regions Ed including a region partitioned by the virtual line L3 and the virtual line L1 in the formation region Ec located on the first quadrant side, a region partitioned by the virtual line L4 and the virtual line L2 in the formation region Ec located on the fourth quadrant side, and a region in which the hole center is arranged on the virtual line L3 and the virtual line L4.

9. The ink cartridge according to claim 1, wherein:

the engagement part further comprises:

a fit-in rib formed at a circumferential edge of a body on a rear side;

an engagement hole formed at a substantially central portion of the body and engaging with a supply opening communicating together an inside and an outside of the ink container stored in an outer package having an opening of a rectangular shape; and an engagement rib provided upright at a circumferential edge of the engagement hole in the same direction as a direction of the fit-in rib, and the tag-removing hole is at least partially formed in a formation region Ee as a region located on an engagement rib side at a position covered by the communication tag bonded between the fit-in rib and the engagement rib and also partitioned by a virtual perpendicular line PL passing through a center of gravity G of the communication tag to form a right angle with the fit-in rib on a long side.

10. The ink cartridge according to claim 9, wherein:

the tag-removing hole is formed in a formation region Ef as a region included in the formation region Ee and partitioned by virtual lines L5 and L6 linking together a center O1 of the engagement hole and corner parts at which the fit-in rib on a short side and the fit-in rib on a long side intersect with each other and which are located on a side on which the communication tag is bonded.

11. A method for tag discrimination comprising:

inserting a bar-like member in the tag-removing hole formed in the ink cartridge according to claim 1 and then removing a floating part of the communication tag bonded to the engagement part; and pinching the floated portion and removing the communication tag from the engagement part for discrimination of the communication tag.

12. A method for reproducing an ink cartridge according to claim 1, the method comprising, for bonding a replacement communication tag, the following:

removing the communication tag.

13. The method for reproducing an ink cartridge according to claim 12, wherein:

the tag-removing hole is formed at a position located out of a corner part of the fit-in rib provided at a circumferential edge of the engagement part engaged with an outer package in which the ink container is stored;

a bar-like member is inserted in the tag-removing hole to float part of the communication tag bonded to the engagement part; and the partial portion is pinched and pulled to remove the communication tag from the engagement part.

14. The method for reproducing an ink cartridge according to claim 12, further comprising:

arranging the replacement communication tag in a manner so as to partially superpose part of the replacement communication tag on a tag-removing hole formed at a position located out of the corner part of the engagement part.

15. A method for reproducing an ink cartridge according to claim 1, the method comprising:

arranging a replacement communication tag in a manner such as to be partially superposed on a tag-removing hole formed at a position located out of a corner part of an engagement part engaging with a printer provided with a function of reading the cartridge information and supplying ink in an ink container.

16. The method for reproducing an ink cartridge according to claim 15, wherein:

the engagement part comprises:

a fit-in rib formed at a circumferential edge of a body;

an engagement hole formed at a substantially central portion of the body and engaging with a supply opening communicating together an inside and an outside of the ink container stored in an outer package having an opening of a rectangular shape;

an engagement rib provided upright at a circumferential edge of the engagement hole in the same direction as a direction of the fit-in rib;

a bonding region for bonding the communication tag formed of a chord part and a circular arc part and formed in a state in which the chord part is in contact with a base end of the fit-in rib on a short side at a position horizontally adjacent to the engagement hole; and the tag-removing hole is formed in a formation region Ea as a region within the bonding region located in a first quadrant and a fourth quadrant obtained upon partitioning with an orthogonal coordinate system having, as coordinate axes, a virtual line X and a virtual line Y, the virtual line X passing through, as an origin, a center O of a virtual circle VC formed by linking together ends part of the circular arc part of the bonding region and positively directing a direction parallel to a long side of the engagement part and approaching the engagement rib, the virtual line Y passing through the center O in a direction orthogonal to the virtual line X.

17. The method for reproducing an ink cartridge according to claim 15, wherein:

the engagement part comprises:

a fit-in rib formed at a circumferential edge of the body on a rear side;

an engagement hole formed at a substantially central portion pf the body and engaging with a supply opening communicating together an inside and an outside of the ink container stored in an outer package having an opening of a rectangular shape; and an engagement rib provided upright at a circumferential edge of the engagement hole in the same direction as a direction of the fit-in rib, and the tag-removing hole is at least partially formed in a formation region Ee as a region located on an engagement rib side at a position covered by the communication tag bonded between the fit-in rib and the engagement rib and also partitioned by a virtual perpendicular line PL passing through a center of gravity G of the communication tag to form a right angle with the fit-in rib on a long side.

18. The method for reproducing an ink cartridge according to claim 1, wherein:

an adjusting member for adjusting an arrangement position of the replacement communication tag is provided between the replacement communication tag and the engagement part.

19. The method for reproducing an ink cartridge according to claim 1, further comprising:

loading, on a replacement outer package, the ink container provided with the replacement communication tag.

20. The method for reproducing an ink cartridge according to claim 1, further comprising:

injecting a predetermined amount of ink into the ink container.

* * * * *